US011285377B2

(12) United States Patent
Talanian

(10) Patent No.: US 11,285,377 B2
(45) Date of Patent: Mar. 29, 2022

(54) ADJUSTABLE BOOT BINDING APPARATUS

(71) Applicant: Harry Jason Talanian, Chicago, IL (US)

(72) Inventor: Harry Jason Talanian, Chicago, IL (US)

( * ) Notice: Subject to any disclaimer, the term of this patent is extended or adjusted under 35 U.S.C. 154(b) by 0 days.

(21) Appl. No.: 16/893,919

(22) Filed: Jun. 5, 2020

(65) Prior Publication Data

US 2020/0384345 A1 Dec. 10, 2020

Related U.S. Application Data

(60) Provisional application No. 62/926,649, filed on Oct. 28, 2019, provisional application No. 62/857,400, filed on Jun. 5, 2019.

(51) Int. Cl.

| | |
|---|---|
| ***A63C 10/18*** | (2012.01) |
| ***A43B 5/04*** | (2006.01) |
| ***A63C 10/24*** | (2012.01) |
| ***A63C 10/10*** | (2012.01) |

(52) U.S. Cl.

CPC ..... *A63C 10/18* (2013.01); *A43B 5/0403* (2013.01); *A63C 10/103* (2013.01); *A63C 10/24* (2013.01)

(58) Field of Classification Search

CPC ..... A63C 10/24; A63C 10/18; A63C 10/103; A43B 5/0403

See application file for complete search history.

(56) References Cited

U.S. PATENT DOCUMENTS 5,056,509 A * 10/1991 Swearington ..... A61F 5/0127 602/29
5,090,138 A * 2/1992 Borden ..... A43B 7/20 36/102
5,356,170 A 10/1994 Carpenter
5,454,173 A * 10/1995 Falguere ..... A43B 5/0411 36/117.2
5,690,350 A 11/1997 Turner
5,771,609 A * 6/1998 Messmer ..... A43B 5/0401 36/89
5,802,741 A 9/1998 Turner (Continued)

FOREIGN PATENT DOCUMENTS

DE 19805774 8/1999
DE 102004034594 2/2006

(Continued)

*Primary Examiner* — Brian L Swenson

(74) *Attorney, Agent, or Firm* — Fitch, Even, Tabin & Flannery LLP

(57) ABSTRACT

A binding apparatus for a snowboard is provided including a base plate having a pivot portion, an elongate arm member, and a cuff member for receiving a portion of a rider's boot or leg. The base plate may be affixed to the snowboard such that a boot may be coupled to a footbed thereof at an angle relative to the lateral axis of the snowboard. The elongate arm member is pivotably coupled to the pivot portion of the base plate at a first end portion thereof, and the cuff member is coupled to the elongate arm member. The elongate arm member is configured to pivotably rotate about an axis of rotation of the pivot portion such that the elongate arm member and cuff member coupled thereto are capable of moving fore and aft of a lateral axis of a snowboard.

20 Claims, 18 Drawing Sheets

(56) References Cited

U.S. PATENT DOCUMENTS

| | | | | |
|---|---|---|---|---|
| 5,815,953 | A * | 10/1998 | Kaufman | A43B 5/04 36/118.3 |
| 5,832,635 | A * | 11/1998 | Finney | A43B 5/0401 36/118.8 |
| 6,027,136 | A | 2/2000 | Phillips | |
| 6,082,026 | A | 7/2000 | Sand | |
| 6,102,429 | A | 8/2000 | Laughlin | |
| 6,168,173 | B1 | 1/2001 | Reuss | |
| 6,231,066 | B1 * | 5/2001 | Okajima | A63C 10/24 280/14.21 |
| 6,467,795 | B1 | 10/2002 | Hirayama | |
| 6,923,455 | B2 | 8/2005 | Sullivan | |
| 7,210,252 | B2 * | 5/2007 | Morrow | A43B 5/0401 36/117.4 |
| 7,367,579 | B2 | 5/2008 | Elkington | |
| 7,832,742 | B1 | 11/2010 | Duggan | |
| 2003/0230870 | A1 * | 12/2003 | Sabol | A63C 10/18 280/618 |
| 2012/0025490 | A1 * | 2/2012 | Van Bregmann, Jr. | A63C 10/18 280/607 |
| 2013/0292922 | A1 | 11/2013 | Gyr | |
| 2015/0360117 | A1 * | 12/2015 | Markman | A63C 10/06 280/613 |
| 2017/0368445 | A1 * | 12/2017 | Mehiel | A43B 5/0401 |
| 2018/0229102 | A1 * | 8/2018 | Harris, III | A63C 10/06 |

FOREIGN PATENT DOCUMENTS

| | | |
|---|---|---|
| EP | 0959702 | 12/1999 |
| EP | 1175250 | 1/2002 |
| EP | 1637048 | 3/2006 |
| JP | H10117803 | 5/1998 |
| JP | 2812912 | 10/1998 |
| WO | 2012113011 | 8/2012 |

* cited by examiner

ADJUSTABLE BOOT BINDING APPARATUS

CROSS-REFERENCE TO RELATED APPLICATIONS

This application claims the benefit of U.S. Provisional Application No. 62/926,649 filed Oct. 28, 2019 and U.S. Provisional Application No. 62/857,400 filed Jun. 5, 2019, which are both hereby incorporated by reference in their entirety.

FIELD

This disclosure relates to adjustable binding apparatuses and, more specifically, adjustable binding apparatuses and systems for snowboards.

BACKGROUND

Snowboarding is a popular winter activity that requires both balance and control. Snowboards typically include boot bindings to affix a rider's boots to the snowboard, which allows the rider to control the snowboard via weight transfer and foot movement in both the lateral (side-to-side across the width of the snowboard) and longitudinal (forward and rearward along the length of the snowboard) directions. Boot bindings may be affixed to the snowboard using known engagement techniques to keep the snowboard attached to the rider and are typically mounted to the snowboard in a fixed orientation. By leaning onto the balls or heels of the rider's feet, the rider can turn the snowboard by respectively engaging a toe-side edge or heel-side edge of the snowboard.

While some snowboarders prefer snowboarding for leisure or for acrobatic jumps and stunts (typically using "soft" boots and often referred to as "freeriding" or "freestyle"), other snowboarders prefer high-speed runs with turns that require greater control over the snowboard (typically using "hard" boots and often referred to as "alpine style snowboarding," "freecarving," or "euro-carving"). Typically, each of these riding styles requires different sets of equipment.

For freeriding or freestyle riding, conventional boots and bindings are often referred to as "soft" and provide more of a natural range of motion in all directions, except to the rear. Bindings for soft boots typically include a toe strap, an ankle strap, and a "high-back" brace. The toe strap and ankle strap affix the rider's foot on the snowboard, and the high-back brace limits movement of the lower portion of a rider's leg while on the snowboard. High-backs are typically either vertical or angled slightly forward and function to transmit the rider's leg movement force to the snowboard, in particular by bracing the backside of the rider's leg when engaging the heel-side edge of the snowboard. In short, high-backs enhance the snowboarder's ability to control the snowboard while using the heel side edge, by providing a brace to lean against in the rear direction, which many snowboarders feel is desirable, especially because the shin muscle is not strong enough to accomplish this without the added leverage of the high-back.

For alpine carving or freecarving, hard ski-type boots (or "hard boots") provide more rigidity and leverage to control the snowboard than soft boots. Such precision control is especially critical where "carving" through the snow, often at increased speed, and often is desirable for purposes of style, for competition in slalom events, for snowboard cross competitions, etc. In order to carve, the rider places weight over the carving edge of the snowboard to laterally tilt the snowboard via weight transfer. Centripetal force generated from the turn prevents the rider from falling over, even though the rider's body position might be substantially parallel to the snow surface while in a carving turn. The result is less sliding/skidding action of the snowboard, but instead creating a thin "pencil-line" through the turn that substantially maintains speed.

While carving, riders often desire to rapidly shift from heel-side to toe-side turns, and back. To increase quickness in going from one edge to the other, carving-style riders often favor a narrower snowboard. When using a narrower snowboard, however, riders are required to position their feet at a steeper angle relative to the lateral axis of the snowboard (typically greater than 40 degrees and often greater than 60 degrees from the lateral axis, depending on the board) to eliminate any boot overhang off the side of the snowboard, either heel or toe. This boot overhang can result in the rider not being able to maintain the desired turn radius because of drag created by portions of the foot. With this steeper angled foot position, the rider's feet face in a more forward direction along the longitudinal axis of the snowboard, such that the rider's toes are frontward of the rider's heels.

Hard ski-type boots discussed above are often preferred for carving-style snowboarding for at least two reasons. First, when the snowboarder's feet are angled as described above, high-back bindings of the conventional soft boot snowboard binding do little to enhance the snowboarder's ability to turn or balance on the snowboard, because the angle of the rider's feet is nearly parallel to the length of the snowboard, as described above. While the high-back binding may prevent rearward motion (away from the toes) of the rider's legs, the high-back binding does little to inhibit side-to-side movement of the user's legs that would otherwise be desirable for improved lateral control on this narrower snowboard. Second, the leg strength of the rider cannot handle this type of lateral force exerted when attempt to "edge" the snowboard, unless their feet are at much shallower angles (less than approximately 25 degrees from the lateral axis of the snowboard). Therefore, some snowboard riders prefer hard boots because hard boots increase side-to-side leverage, allowing the rider with hard boots to turn and control the snowboard effectively.

However, hard boot setups have a number of issues, such as, the hard boot makes it difficult to walk when disengaged from the snowboard. Also, a steeper-angled riding stance, coupled with the use of hard boots, can be uncomfortable because the rider's feet are in a fixed position at steep angles that don't line up well with normal human anatomy and place stress on the rider's lower leg and knees. For example, while wearing a hard boot, a rider may be inhibited from attempting a squat position to lower his/her center of gravity for more aggressive turning because the lower part of the leg is allowed only a small amount of flex in any direction. As a result, the rider's buttocks can only move backward, away from the direction of the toes, which can create issues with the rider's center of gravity. To compensate for this and attempt to maintain a center of gravity, the rider is forced to fold at the hips to bring the weight of the upper body in the other direction, forward. This folded position is not nearly as stable as a normal squat position where the upper body can stay more upright. Riders sometimes try to correct the "folding" of the body issue by setting up their stance on the snowboard so that they can tuck the rear knee behind the front knee in a "knock-kneed" stance. This stance can occasionally improve comfort when squatting and help with center of gravity issues, but when the rider's knees are positioned close to one another, this dramatically reduces stability and strength at high speeds when larger forces are in play. Although flexible spacers can be used as part of the "hard boot bindings", these hard boots and hard boot binding setups provide little flex overall in any direction and this is not a real solution to the underlying problem.

Further, the rigid boots themselves are uncomfortable and prone to problems with fit. Riders often experience overall discomfort or more specific maladies such as "heel slip" and/or "shin-bang." Heel slip results when the rigid boots have too much volume for the rider's foot or where volume is in the wrong place. In the other direction, when rigid boots are too tight, circulation decreases and cold toes result. Existing solutions to the heel slip problem have often proven unsatisfactory. For example, some boots include heat molded liners, which conform to the rider's foot, ankle, and lower leg, but when applying extreme forces through the rider's lower leg heel slip can still occur. Shin bang is caused when riders attempt to lower themselves into a squat position, pressing the rider's shin against the cuff of the hard boot in a localized area. This pressing force, coupled with non-uniform terrain, can cause the boot to bang against the front parts of the rider's leg causing bruising or even abrasions. Shin bang is exacerbated because hard boots typically only reach approximately 75% of the way up the shin/calf of a rider. Shorter boots place more stress on localized areas of the rider's lower leg. Attempting to solve this problem by using a taller hard boot to spread the pressure over slightly greater area would further restrict movement and would exacerbate the center of gravity issue described above.

To alleviate the discomforts described above, riders in conventional hard boots sometimes add "cant" to the binding or boot to change the side-to-side angle of the hard boot, meaning in a lateral direction relative to the foot. In addition to cant, a rider can add heel lift or add toe lift, which pitches the foot forward or rearward. Cant and heel or toe lift can be added on either or both feet and at any angular orientation relative to the snowboard. Adjustments of this nature sometimes improve the rider's comfort, but ultimately do not solve the underlying problems discussed above. Some riders endlessly adjust their boots and the cant of their boots but are unable to arrive at an acceptable solution. Further, many such adjustments change the way the body interacts with the snowboard edges, causing the rider to compensate in some other way and often reducing control. In sum, each of these solutions is deficient because the rider is trapped in a rigid boot that essentially fixes the position of the lower leg relative to the snowboard.

Soft boot set ups, although comfortable, also have issues. High-backs on existing bindings are not intended to move but instead provide a fixed brace on the back of the rider's leg as previously described. Once the high-back is set with the desired amount of forward lean, it remains in that fixed position. Existing high-backs typically pivot forwardly toward the toes of the binding, allowing adjustable forward lean and also allowing the binding to be folded and stowed for transportation or while boarding a chairlift. But existing high-backs do not support the lower legs as well when riders shift their stance. For instance, riders often angle their lower legs forward toward the tip of the snowboard (forward weight transfer) when entering a turn or rearward toward the tail of the snowboard (rear weight transfer) when exiting a turn. Because the rider's lower leg tends to move along the longitudinal length of the snowboard, the high-back provides minimal support in those circumstances. This issue becomes even more pronounced under two circumstances: first, when performing aggressive carving turns, and second when the rider adjusts the binding angles to large angles relative to the lateral axis of the snowboard. In both circumstances, the rider's lower leg has less engagement (or sometimes less centered engagement) with the existing high-backs. Further, when the rider's lower leg is off center from the high-backs the side of the high-back often causes pressure areas on the rider's boot and in turn on the rider's lower leg, causing pain.

Some conventional snowboard bindings are designed with a circular plate attached to the board that allows the binding to rotate relative to the board. For example, four screws may be used to secure the plate to the snowboard, through holes in the plate. The plate includes multiple sets of holes such that the plate can be positioned laterally at the center of the board or biased to one side or the other. Regardless of the lateral position of the circular plate, the binding rotates at a pivot point located in the approximate middle of the conventional binding's footbed. Although this arrangement allows selective angular adjustment of the binding, it does not provide an adequate mechanism to do so without also changing the heel position in a longitudinal direction on the snowboard. Because, in conventional bindings, the binding rotates around the middle of the footbed, the position of the heel changes whenever the angle of the binding is changed. Thus, it is difficult to orient the heel of the snowboard boot with an edge of the snowboard, and at a fixed longitudinal location along the board. Doing so requires first rotating the binding to a desired angle. Second, the binding must be placed at a location in a longitudinal direction of the board such that the heel can be placed at the desired location. If the binding angle needs to change, the placement of the binding must also change to maintain the heel at the desired location.

It would thus be desirable for a snowboard binding apparatus and snowboard boot to combine the comfort and flexibility of a soft boot with the control and leverage of the known hard boots and to provide riders a means for improved weight transfer and improved control.

Figure 1:
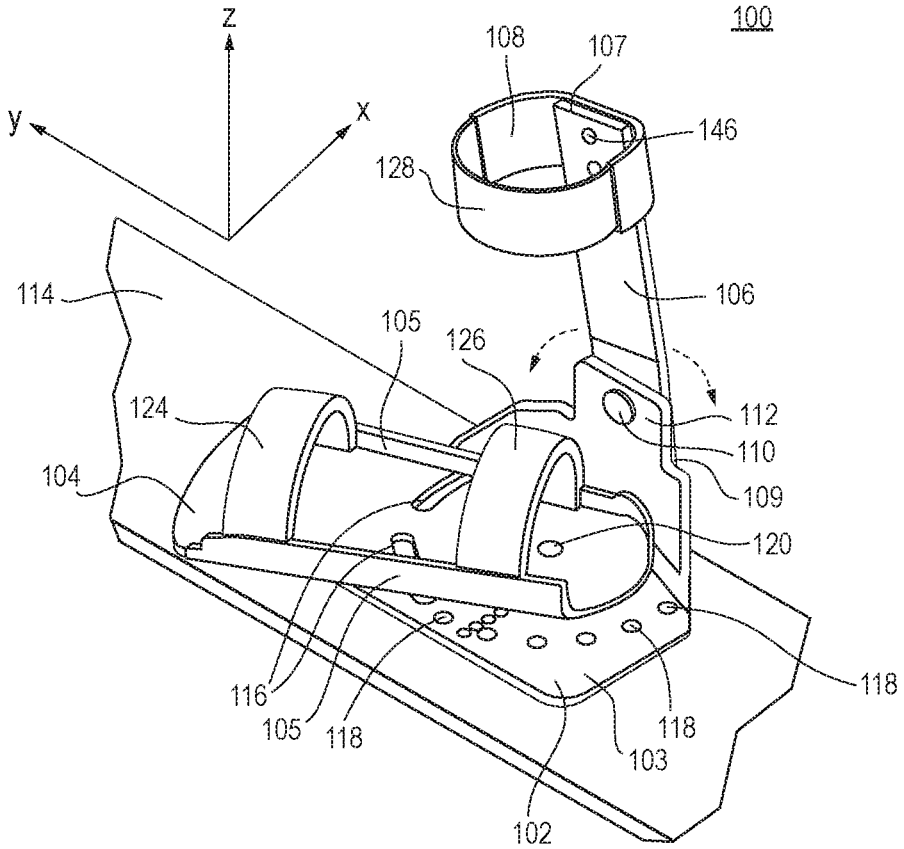
FIG. 1 is a perspective view of an example binding apparatus for a snowboard, showing a base plate, a footbed selectively coupled to the base plate, an elongate arm member pivotably coupled to the base plate at a pivot portion thereof, a cuff member coupled to the elongate arm member, and three straps (a toe strap, an ankle strap, and a shin strap)

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted to facilitate a less obstructed view of these various embodiments. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, in accordance with the present disclosure, a binding apparatus for a snowboard is provided including a base plate, a footbed configured to be selectively coupled to the base plate, an elongate arm member pivotably coupled to the base plate, and a cuff member coupled to the elongate arm member for receiving a portion of a rider's boot or leg. The base plate may be affixed to a snowboard and the footbed affixed to the base plate such that a boot may be coupled to the footbed portion thereof at an angle relative to a lateral axis of the snowboard. The elongate arm member is coupled to a pivot portion of the base plate at a first end portion thereof such that the elongate arm member and cuff member coupled thereto are movable fore and aft of a lateral axis of a snowboard, but are substantially rigid along the lateral axis. In one example, the elongate arm member is configured to pivotably rotate about an axis of rotation of the pivot portion, which is coincident with a lateral axis of a snowboard, such that the elongate arm member and cuff member coupled thereto pivot fore and aft along the axis of rotation.

The binding apparatus beneficially provides a binding for a snowboard having a substantially rigid side-to-side connection to the snowboard (i.e., along a lateral axis of the snowboard) and thus reinforces the rider's connection and leverage on the snowboard's edges, which improves the rider's ability to control the snowboard. In contrast with known bindings and boots, the binding apparatus provided herein simultaneously freely allows forward to rearward movement along the longitudinal length of the snowboard.

In addition, the position of the binding apparatus is adjustable side-to-side across the width of the snowboard such that the heel of the binding apparatus can easily be placed in close proximity to the edge of the snowboard. Angular adjustment of the footbed does not affect the position of the heel with respect to the edge of the snowboard, and more importantly, does not affect the position of the rider's ankle joint with respect to the pivot portion of the base plate.

In one described example, the elongate arm member is angled outwardly in the direction of the lateral axis of the snowboard. In a separate described example, the elongate arm member is angled inwardly in the direction of the lateral axis. The elongate arm member may be interchangeable with other elongate arm members which use a different angle in the direction of the lateral axis, or a different length, and can also be reversed to provide the angle either inwardly or outwardly to make the binding apparatus adaptable to fit numerous riders. Alternatively, the elongate arm member may be fixed at a predetermined orientation, to correspond to the particular anatomy or preferences of an individual rider or based at least in part on the width of the snowboard being used.

In another described example, the footbed further includes a hole located in a heel portion of the footbed such that the footbed is configured to pivot about the hole to be selectively secured at various adjustable angles. In another described example, the footbed further includes at least one arcuate slot having a radius of curvature corresponding to the distance between the hole and the arcuate slot. So configured, the at least one arcuate slot allows angular adjustment of the footbed relative to the base plate and the snowboard such that it may be rotated around the axis aligned with the hole and selectively secured via a fastener at different angles.

In some forms, the base plate further includes at least one row of holes extending parallel to the pivot portion axis of rotation. The base plate may also include exactly two rows of holes extending parallel to the pivot portion axis of rotation to facilitate secure attachment of the base plate to the snowboard. In another described example, the base plate further includes a first threaded hole to receive a fastener that passes through the hole in the heel portion of the footbed. In another described example, the base plate further includes at least one second threaded hole to receive a fastener that passes through the at least one arcuate slot. In examples with a plurality of second threaded holes, the holes are arranged along an arc having a center point at the first threaded hole and a radius of curvature corresponding to the radius of curvature of the at least one arcuate slot on the footbed.

In addition, the binding apparatus may further include at least one strap encircling all or a portion of the cuff member. In another described example, the footbed portion of the binding apparatus further comprises a heel portion and a toe portion, wherein the pivot portion axis of rotation of the elongate arm substantially aligns with an ankle joint of the rider. In some forms, the heel and toe portions of the footbed may include associated straps for securing a rider's boot thereto.

In yet another described example, the binding apparatus further comprises means for adjusting the height of the footbed relative to the pivot portion. This example advantageously allows the rider to adjust the location of the pivot axis relative to the rider's ankle joint, by adjusting the height of the footbed relative to the pivot portion by adding spacers of various sizes or angles (providing cant to the foot bed) or through use of a variety of known devices for adjusting the position of the pivot axis within the pivot portion.

In still another described example, the binding apparatus further comprises means for adjusting the position of the base plate along the lateral axis of the snowboard relative to the longitudinal axis of the snowboard. This adjustment means may include, for example, incorporating multiple mounting holes or slotted or channeled mounting holes in the base plate, for example to accommodate snowboards of differing widths. In this example, the footbed may be configured to rotate at a heel portion thereof. Thus, the location of the heel portion remains substantially unchanged as the footbed rotates. This configuration makes it easier to orient the heel portion of the base plate with the heel-side edge of the snowboard. Thus, one advantage of the invention is that the binding can be oriented relative to the heel-side edge of the board and subsequent adjustment of the pivot angle: (1) does not affect the alignment of the rider's ankle joint with the pivot axis of the elongated member, and (2) does not affect the alignment of the rider's heel relative to the edge of the board. Subsequent adjustment of the angle of the footbed does not cause, for example, overhanging of the heel portion off the edge of the snowboard.

In another described example, the pivot portion of the binding apparatus further comprises at least one aperture formed along the pivot portion axis of rotation on the base plate. In such an example, the first end portion of the elongate arm member may include an aperture coaxially aligned with the at least one aperture of the pivot portion on the base plate, the aperture of the first end portion and the at least one aperture of the pivot portion configured to receive a fastener for pivotably coupling the elongate arm member to the pivot portion. However, the elongate arm member may be pivotably coupled to the pivot portion of the base plate using a variety of known coupling means.

In one described example, the elongate arm member is at such length so that the cuff and corresponding strap is positioned at the top of the rider's boot when rider is using a traditional height snowboard boot. In another described example, the elongate arm member is at such length so that the cuff is positioned just below the rider's knee and is affixed directly to the rider's leg. In another described example, the elongate arm member is at such length so that the cuff is positioned substantially below the top of the rider's boot to allow for the most flexibility for freestyle or terrain park riding. To further enhance this flexibility, the cuff strap can be removed altogether.

In operation, a rider may secure his or her boot to the footbed portion at an angle relative to the lateral axis of the snowboard and position a portion of the upper part of the rider's boot or the rider's leg in the cuff member such that the rider's leg is permitted to move forward and rearward along the longitudinal length of the snowboard. The elongate arm member and cuff member function to transmit force applied by the rider's leg to the snowboard in a lateral direction. For example, the rider may lean to the side over either edge of the snowboard to apply force to the elongate arm member and cuff member coupled thereto to apply said force to the snowboard. That is, the elongate arm member and cuff member provide a substantially rigid connection to the snowboard and support the rider's leg in the lateral direction while allowing substantially free forward and rearward movement along the longitudinal axis of the snowboard. In short, the binding apparatus provided permits riders to flex their legs so that their knees follow an arcing path parallel to the longitudinal axis of the snowboard which is otherwise described as "tip-to-tail" motion, regardless of the orientation of the rider's feet.

This flexing motion can be done both freely and comfortably, to allow for any depth of squatting or weight transfer toward the tip or tail of the snowboard while snowboarding. Allowing this forward and rearward movement advantageously permits riders to lower their center of gravity while keeping their weight substantially centered over their feet. In contrast, as described above, known hard boots coupled to known hard boot bindings substantially prevent movement of the lower legs in the tip-to-tail direction, such that when a rider squats it tends to place the rider's center of gravity rearward of the rider's feet (away from their toes) and reduces stability and strength at high speeds. Further, allowing the rider's ankles to flex in a tip-to-tail manner results in increased control and allows riders to transfer their weight in the forward and rearward direction of travel (or tip-to-tail) while snowboarding to balance against forces acting on the snowboard. Also, in contrast, known soft boots coupled to known soft boot bindings are not suitable for narrow snowboards which require foot angles greater than approximately 25 degrees relative to the lateral axis of the snowboard because they do not offer enough support to allow a rider to effectively control the snowboard by way of the edge, toeside or heelside. As the foot angles increase when using known soft boots and soft boot bindings the calf muscles and shin muscles of the rider become less effective in applying force to the edge.

Also, in operation with the binding system described herein, the rider's leg/knee is simultaneously inhibited from movement in a lateral direction. When the rider exerts lateral force on the cuff member, that force applies leverage to the snowboard edge to maneuver the snowboard and maintain edge control. In binding systems in which two such binding apparatus are attached to the snowboard, the rider can exert lateral force with either or both legs, in either the heel-side or toe-side lateral direction, on cuff members in either or both binding apparatus. In such binding systems, the rider may even exert opposing forces on opposite legs to cause a twisting of the snowboard. One benefit of positioning the cuff member just below the knee is a resulting decrease in required force to apply leverage to the edge of the snowboard. Decreasing required force reduces the possibility of discomfort as described above.

In further alternative forms, a modified high-back binding for soft boots or a modified hard boot is provided for similarly permitting tip-to-tail freedom of leg movement but restricting lateral leg movement. Such a modified high-back binding may include a footbed with angle adjustability relative to the lateral axis of the snowboard, and a pivoting heel-cup with an angle adjustability relative to the forward or rearward direction (toward or away from the toes). The footbed may be similar to a traditional soft boot binding and incorporates adjustable pivot locations such that the pivoting heel-cup can be selectively mounted on the footbed to allow for forward lean if desired. A pivotable elongate arm member may be mounted on the heel cup or another portion of the footbed such that the pivot axis is substantially coincident with a lateral axis of the snowboard. The elongate arm member may also include a cuff member for receiving a portion of a rider's leg or coupling to the top of a rider's soft boot thereby securing the rider's leg via a third connection point. The elongate arm member may be coupled to a selected one of a plurality of apertures extending about the pivoting heel cup to adjust a pivoting axis thereof to directly align with the longitudinal axis of the snowboard regardless of the orientation of the binding relative to the snowboard. So configured, the rider can adjust the angle of the footbed relative to the lateral axis of the snowboard, and the rider can couple the elongate arm member to a selected aperture of the pivoting heel cup to cause the pivoting axis thereof to remain aligned with the longitudinal axis.

Referring now to the drawings, and more specifically to FIG. 1, an example of such a binding apparatus 100 includes a base plate 102, the base plate 102 having a mounting portion 103 and a pivot portion 112. The base plate 102 is shown attached to a snowboard 114, and a footbed 104 is shown mounted to the base plate 102. The footbed 104 includes toe strap 124 and an ankle strap 126, which are designed to secure the rider's foot to the footbed. As illustrated in FIG. 1, the footbed 104 includes side walls 105 that may, for example, assist in securing the sides of a user's boot. The footbed 104 further includes mounting means for selectively securing the footbed 104 to the base plate 102 at various pivotable positions. As illustrated, the footbed 104 includes a hole 120 about which the footbed 104 is configured to pivot and arcuate slots 116 configured to align with holes 118 of the base plate 102. In some forms, a fastener such as a screw or bolt is configured to pass through each of the arcuate slots 116 and engage in a respective one of the holes 118 in the base plate 102. By selecting one of the holes 118 and tightening the fastener against the arcuate slots 116, the arcuate slots 116 allow selective adjustment of the angle of the footbed 104.

As illustrated, an elongate arm member 106 is pivotably coupled to a pivot portion 112 of the base plate 102 such that the elongate arm member 106 may be rotatable thereabout an axis thereof, as described in more detail below. A cuff member 108 may be provided on the elongate arm member 106, such as at one end of the elongate arm member 106, to support a portion of a rider's upper boot or a rider's leg such that the rider's leg may pivot forward and rearward along the longitudinal length of the snowboard (tip-to-tail) with the elongate arm member 106 while the elongate arm member 106 rotates via the pivot portion 112 of the base plate 102.

The axis of rotation for the elongate arm member 106 is substantially aligned with the lateral axis of the snowboard 114 (lateral or side-to-side direction is illustrated by the arrow "X"). As illustrated, the orthogonal axes "X," "Y," and "Z" define the lateral, longitudinal, and upward directions relative to the snowboard 114. Although the axis of rotation for the elongate arm member 106 is preferably aligned with the lateral axis of the snowboard, it may be misaligned in the longitudinal direction illustrated by the arrow "Y," preferably within about 5 degrees of the lateral axis "X" of the snowboard, or by as much as about 20 degrees misaligned. Such misalignment may accommodate, for example, asymmetrical snowboards, limitations in the adjustability of the pivot axis or pivot locations, or the rider's preferences or anatomy. In general, any longitudinal misalignment between the axis of rotation for the elongate arm member 106 and the lateral axis "X" of the snowboard 114 is likely to reduce the rider's leverage in either the heel-side or toe-side lateral direction of the snowboard 114. Likewise, the axis of rotation for the elongate arm member 106 may extend upwardly or downwardly as illustrated by the arrow "Z," preferably less than about 10 degrees, or by as much as about 30 degrees. Such vertical misalignment may accommodate, for example, asymmetrical snowboards, limitations in the adjustability of the pivot axis or pivot locations, or the rider's preferences or anatomy. The axis of rotation for the elongate arm member 106 may also be simultaneously misaligned in both the longitudinal and vertical directions relative to lateral axis "X" of the snowboard 114. In each example teaching above, the axis of rotation for the elongate arm member 106 is considered substantially aligned with the lateral axis "X" of the snowboard 114 for purposes of this disclosure.

The elongate arm member 106 is preferably of a rigid or substantially rigid, but resilient, material such that the force imparted thereto by the rider's leg does not otherwise deform or break the elongate arm member 106 while the rider is applying a force thereto. For example, the elongate arm member 106 may be formed of materials including metal, plastic, or composite material. Likewise, the base plate 102 and the pivot portion 112 to which the elongate arm member 106 is attached are preferably of a rigid or substantially rigid material for similar reasons. The elongate arm member 106 may be constructed of materials designed to flex to varying degrees or be interchangeable with other arm members having varying degrees of flex. When a rider is snowboarding on smooth, groomed slopes a large degree of flex may not be desired. However, when riding moguls or varying terrain, a rider may choose to use a more flexible elongate arm member 106 which will be more forgiving. For example, a resilient flexible element may be provided in the elongate arm member 106 to provide a predetermined amount of flex to smooth out the ride. Providing some flex might, for example, allow riders to maintain control if they hit an unexpected rut while pressuring an edge of the snowboard. In each of these examples, the elongate arm member 106 is considered substantially rigid for purposes of this disclosure.

In further alternative forms, the elongate arm member of the binding apparatus may be fixedly coupled to the base plate as opposed to pivotably coupled to the pivot portion as described above. In such forms, the elongate arm member may be formed of a flexible, resilient material (e.g., a rubber, flexible polymer, composite material, etc.) such that the elongate arm member may be configured to flex and/or bend in the longitudinal direction of the snowboard while still remaining relatively rigid in the lateral direction. This may be accomplished, for example, by designing the elongate arm member to be more rigid in the lateral direction than in the longitudinal direction such that a much greater force is required to deflect or flex the elongate arm member in the lateral direction than in the longitudinal direction. So configured, the fixedly coupled elongate arm member but may still permit the elongate arm member and cuff member coupled thereto to flex fore and aft along the axis of rotation in a similar manner as described above. Various versions of the elongate arm member 106 may be designed to accomplish the desired behavior, as would be recognized by the person having ordinary skill in the art.

The cuff member 108 for receiving a portion of the rider's leg is configured to be coupled to a second end portion 107 of the elongate arm member 106. For example, the cuff member 108 may be integrally molded around or with the second end portion 107 of the elongate arm member 106 or may be coupled to the second end portion 107 of the elongate arm member 106 using apertures 146 via one or more fasteners such as, for example, threaded screws, bolts, or the like. As illustrated, the cuff member 108 is of a generally arcuate configuration corresponding with, and configured to receive, a portion of the rider's boot or leg such that the generally arcuate cuff member 108 thereby at least partially surrounds the rider's leg. In some forms, multiple cuff members may be provided at differing heights on the elongate arm member 106.

Additionally, the cuff member 108 may include one or more straps (e.g., strap 128) for securing the portion of the rider's leg to the cuff member 108. As illustrated in FIG. 1, the cuff member 108 is of a generally arcuate C-shaped configuration having an opening for receiving the rider's leg within the C-shape. To inhibit the rider's leg from being removed from the cuff member 108 while snowboarding, one or more straps (e.g., strap 128) may be provided to secure the rider's leg therein. For example, a hook-and-loop strap, such as Velcro®, or ladders with ratchets as used in many snowboard binding applications may be used to wrap around the C-shaped cuff member 108 to close off the opening thereof and secure the rider's leg therein. The cuff member 108 may likewise be of a rigid or substantially rigid, resilient material to withstand the force imparted thereto by the rider's leg while the elongate arm member 106 is permitted to rotate about the pivoting axis while at the same time being able to flex enough to reduce the circumference of the opening for a snug fit. In some embodiments, the cuff member 108 may include an insert such as padding to improve the comfort of the rider while the rider's leg is positioned in the cuff member 108. For example, foam padding may be provided on the interior surface of the C-shaped cuff member 108 such that the rider's leg may be comfortably positioned therein. Although possibly covered by snow pants while riding, the cuff member 108 should be substantially smooth on both sides that face in the lateral direction so that in the event of a fall, it is inhibited from catching on the snow.

The cuff member 108 and straps (e.g., strap 128) provide a substantially cylindrical structure capable of receiving and securing the rider's leg to the elongate arm 106. The axis of this substantially cylindrical structure may be substantially parallel to the elongate arm member 106 or portions thereof, as illustrated in FIG. 1. To accommodate the varied anatomies of riders having differently shaped calves, however, the cuff member 108 may be attached at a variety of angles relative to the elongate arm 106 and at varying offset distances from an upper portion (e.g., second end portion 107) of the elongate arm member 106. In addition, the angle of the cuff member 108 relative to the elongate arm 106 may be flexible or free to move during use, although the offset distance should be fixed such that the cuff member 108 and straps remain relatively rigid in the lateral direction of the snowboard during use.

Figure 2:
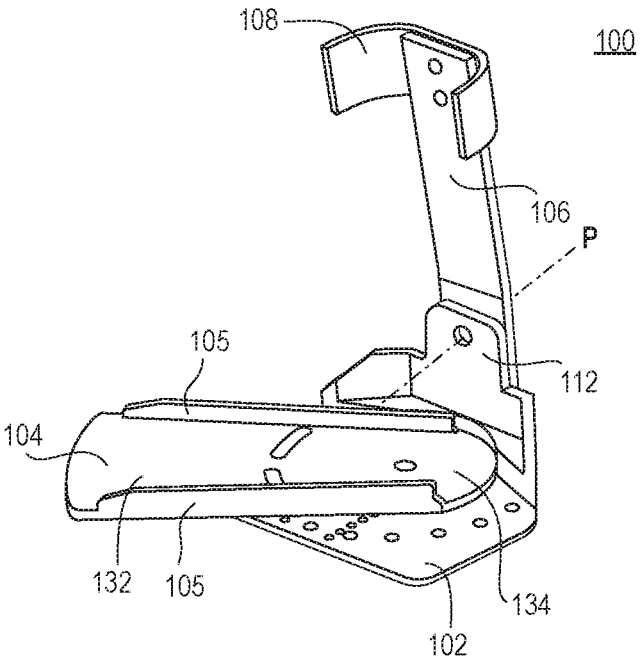
FIG. 2 is a perspective view of the binding apparatus of FIG. 1 with the toe strap, ankle strap, and shin strap removed.
Figure 3:
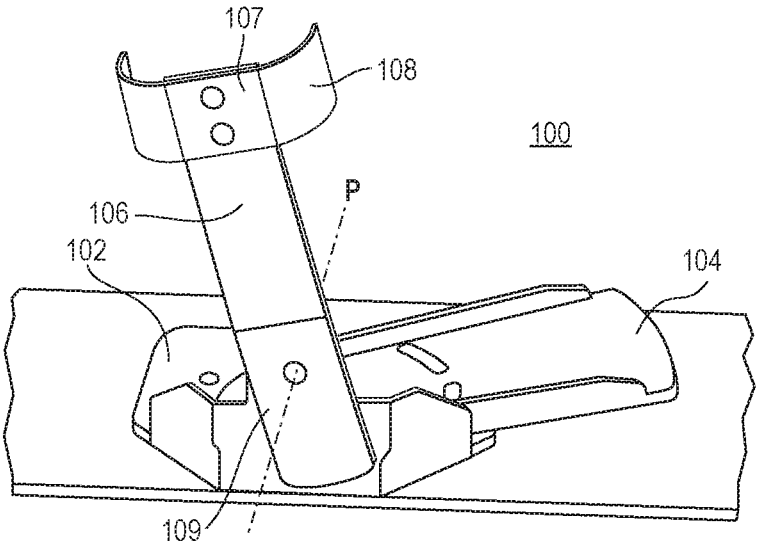
FIG. 3 is a perspective view of an opposite side of the binding apparatus shown in FIG. 2.

Referring to FIG. 2, the footbed 104 includes a toe portion 132 and a heel portion 134. The footbed 104 is configured to receive the rider's foot (e.g., in a boot), with the heel of the rider's foot in the heel portion 134 and the ball of the rider's foot in the toe portion 132. Although not shown, the sidewalls 105 may extend to surround the heel portion 134 of the footbed 104, providing a form of heel cup to constrain the heel of the rider's boot. Alternatively, the sidewalls 105 may include a hole or slot designed to receive a heel loop (as shown, for example, in FIG. 11). A heel loop may be advantageous because it would allow the rider to adjust the position of the boot along the footbed 104. Alternatively, a small mounted post (not shown) attached by threading or other means could be selectively attached at the heel edge of the footbed 104 to constrain the heel of the rider's boot. FIG. 3 illustrates a rear view of the binding apparatus 100 shown in FIG. 2, showing an opposite side of the elongate arm member 106 attached to the pivot portion 112.

Figure 4:
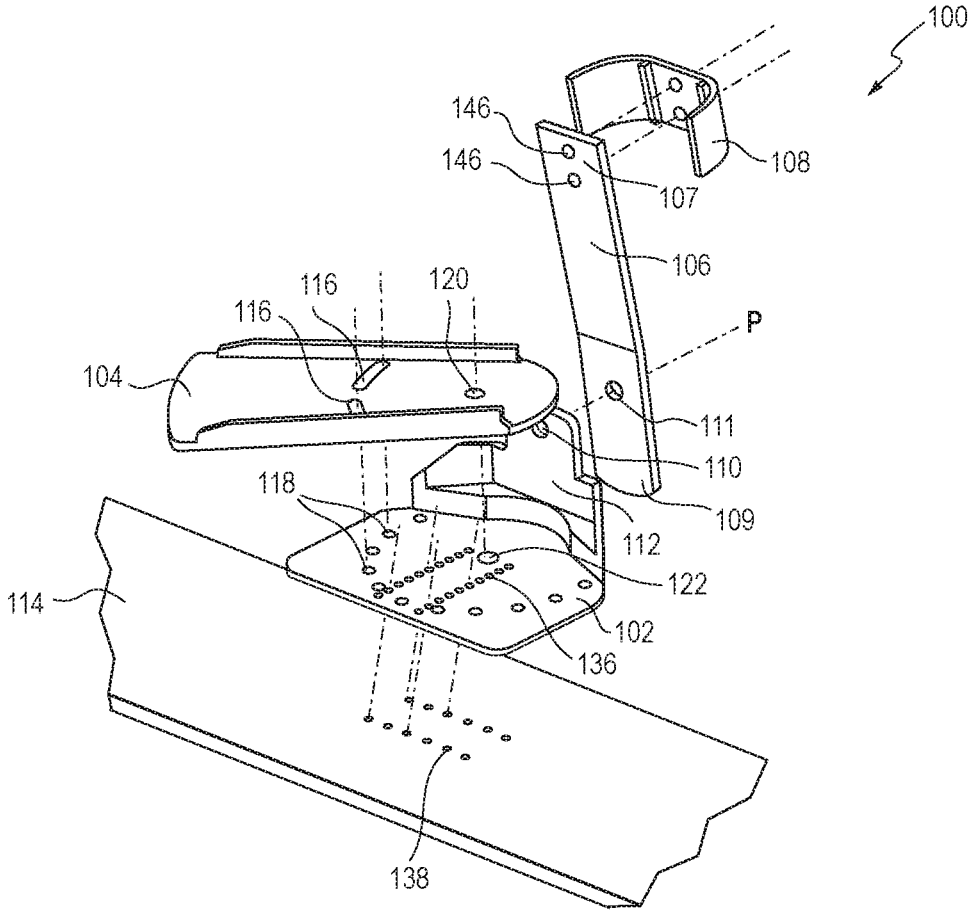
FIG. 4 is an exploded view of the binding apparatus shown in FIG. 2 illustrating various attachment points between the snowboard, the base plate, the footbed, the elongate arm member, and the cuff member.

Referring now to FIG. 4, an exploded view of the binding apparatus 100 is shown. Specifically, FIG. 4 shows the footbed 104 detached from the base plate 102 to show a plurality of apertures 136 that are configured to be used for affixing the base plate 102 to the snowboard 114. In some examples, the plurality of apertures 136 may extend laterally across the surface of the base plate 102 such that the rider may alter the position of the base plate 102 secured to the snowboard 114 by selecting which apertures 136 to align with apertures 138 of the snowboard 114, for example if a rider chooses to position the base plate 102 to allow for the rider's heel to be as close as possible to the heel side edge of the board without substantial overhang that could interfere with the snow when turning aggressively. As illustrated, the apertures 138 are illustrated in a conventional 2×4 hole pattern found on modern snowboards and the apertures 136 may be formed such that they substantially align with the 2×4 hole pattern for connection thereto. So configured, a rider can position the base plate 102 in a desired position on the snowboard 114 by aligning the apertures 136 with the apertures 138 and inserting a fastener such as a threaded screw, rivet, etc. therethrough. In examples including multiple binding apparatuses configured to receive a rider's boot, the base plates may be positioned at different points on the snowboard via respective apertures 136, 138 in each binding apparatus to, for example, adjust the stance width of the rider.

In some embodiments (as described in more detail below with respect to FIG. 10A), the base plate 102 can be formed using two separate parts. For example, the first of the two parts may be the substantially flat portion of the base plate 102 which includes the mounting holes 136 for affixing to the snowboard 114, apertures 118 for aligning with the arcuate slots 116 of the footbed 104, and hole 122 for aligning with hole 120 of the footbed 104. In this example, the second part may be the vertical extension including the hole 110 that is configured to be aligned with, and coupled to, hole 111 such that the elongate arm member 106 may be pivotably coupled to the base plate 102. In such an embodiment, the second part could be mechanically fastened to the first part which could offer some advantages, such as simplification of manufacture. Additionally, a two-part construction may permit exchanging out different versions of the second, vertical part that could offer adjustability to the height of the pivot hole 110 with respect to the snowboard 114. Alternatively, as shown in FIGS. 1-4, the base plate 102 is of a monolithic construction.

Referring again to FIG. 4, the adjustable coupling between the footbed 104 and the base plate 102 will be described in further detail. As shown, the footbed 104 includes one or more apertures in the form of arcuate slots 116 corresponding with the apertures 118 of the base plate 102, and additionally includes hole 120 corresponding with hole 122 of the base plate 102, such that a fastener such as a threaded screw, bolt, or the like may be inserted therethrough to selectively secure the footbed portion 104 to the base plate 102. Depending on rider preference and the width of the selected snowboard, some riders may desire that the footbed portion 104 be positioned at an angle (i.e. a non-zero angle) relative to the lateral axis of the snowboard 114 (illustrated by the arrow "X" shown in FIG. 1). By placing the footbed 104 at a particularly large angle relative to the lateral axis of the snowboard 114, the footbed 104 is oriented to fit the rider's feet on a narrow snowboard, which is preferred for higher speed snowboarding that requires the rider to rapidly shift from one edge to the other edge of the snowboard. The footbed 104 is adjustable and may be positioned at different angles relative to a lateral axis of the snowboard by rotating the footbed 104 about an axis defined by the hole 120, aligning the arcuate slots 116 with different ones of the apertures 118 of the base plate 102, and inserting a fastener therethrough. So configured, the footbed 104 may be selectively secured to the base plate 102 at a plurality of different angles relative to the lateral axis of the snowboard to permit a rider to adjust the angle of the footbed 104 and provide the rider with adjustable control over the selected angle. In some forms, the footbed 104 can be rotated at negative angles relative to the lateral axis of the snowboard 114 to accommodate riders with a "regular" stance (see, e.g., FIGS. 8C and 11) or those who prefer to ride "duck" where a left foot of the rider is positioned at a negative angle and a right foot of the rider is positioned at a positive angle relative to the lateral axis of the snowboard 114.

The base plate 102 may be constructed in different sizes or shapes to accommodate different footbeds and boots having different shapes or profiles. For example, the base plate 102 may be wider in the lateral and longitudinal directions for attachment to a larger footbed 104. However, it should be understood that larger base plates may cause the snowboard 114 to flex differently than a snowboard with a smaller base plate or to flex differently than the snowboard manufacturer intended. To enhance such flexing ability, the base plate 102 may be constructed of materials having varying degrees of flexibility depending on the rider's preferences.

In addition, the footbed 104 may incorporate "cant" and/or heel lift or toe lift such that the bottom of the rider's boot can be adjusted to optimize the rider's position on the snowboard 114. In short, although the present invention reduces the need to cant boots for comfort, some riders may still prefer to make such adjustments to improve control or body position. The need for such adjustments is largely dictated by the anatomy of the individual rider.

As described above, a boot of a rider may be selectively coupled to the footbed 104 of the base plate 102. For example, the footbed 104 may include one or more straps (such as toe strap 124, and ankle strap 126 shown in FIG. 1), clips, or other similar structures to secure the boot of a rider to the footbed 104 and thereby the base plate 102 such that a rigid connection is achieved between the snowboard 114 and the boot of the rider. In one example, the boot may be a "soft" boot of the type that is typically used for snowboarding, and in other examples, a modified shorter version of a typical soft boot can be used. Referring again to FIG. 2, the heel portion 134 of the footbed 104 is substantially aligned with the pivot axis "P" of the elongate arm member 106 such that, during operation, the ankle joint of a rider is generally aligned with the pivot axis P and the lower leg of a rider is generally aligned with the elongate arm member 106 permitting the rider's lower leg and knee to move forward and rearward along the longitudinal length of the snowboard (tip-to-tail). Perfect alignment between the rider's ankle joint and the pivoting axis of the elongate arm member 106 is not required, so long as the elongate arm member 106 is configured to rotate alongside the rider's leg such that movement of the cuff member 108 relative to the rider's leg is minimized.

Figure 5:
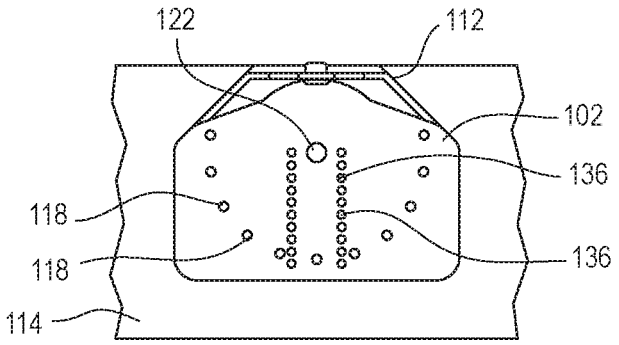
FIG. 5 is a top-side plan view of the base plate illustrating a plurality of apertures for securing the base plate to the snowboard and another plurality of apertures for selectively securing the footbed to the base plate.

FIG. 5 shows the base plate 102 positioned on top of snowboard 114 before the footbed 104 is attached. As shown, the pivot portion 112 of the base plate 102 is positioned as close as possible to the heel side edge of the snowboard 114 but without overhanging, regardless of the width of the snowboard. However, the base plate 102 may be selectively positioned at different locations on the snowboard via the alignment of apertures 136 and 138 described with respect to FIG. 4. Subsequent to affixing base plate 102 to snowboard 114, the footbed 104 can be affixed to the base plate 102 at any selected angle down to the smallest possible angle relative to the lateral axis of the snowboard without the toe portion 132 of the footbed 104 overhanging an edge of the snowboard 114. This configuration allows the rider to use the same base plate 102 for snowboards of varying widths, avoids having any equipment overhanging the edge of snowboard 114, and allows the rider to minimize the angle of the footbed 104 relative to the lateral axis of the snowboard 114 which maximizes stability of the rider.

Figure 6:
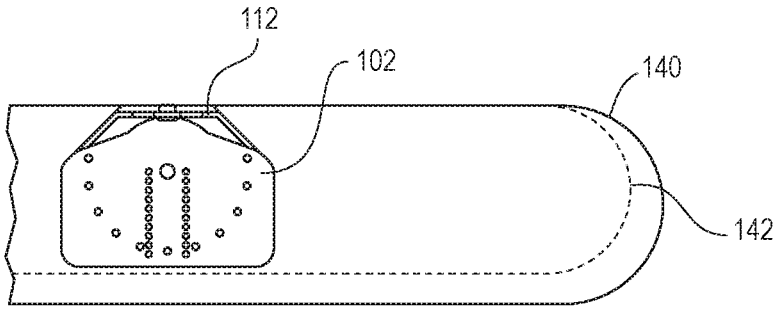
FIG. 6 is a top-side plan view of the base plate similar to FIG. 5 illustrating the base plate positioned on both a wide snowboard and a narrow snowboard when measured along the lateral axis of the snowboard.
Figure 7A:
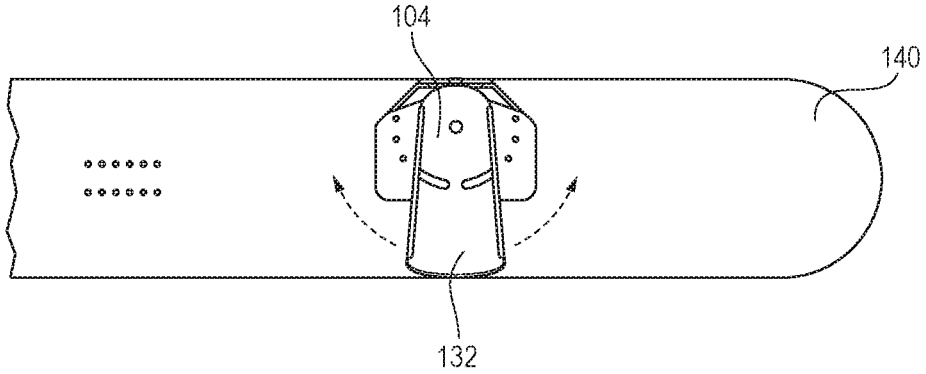
FIG. 7A is a top-side plan view of the base plate with the footbed selectively coupled thereto positioned on a wider snowboard when measured along the lateral axis of the snowboard.
Figure 7B:
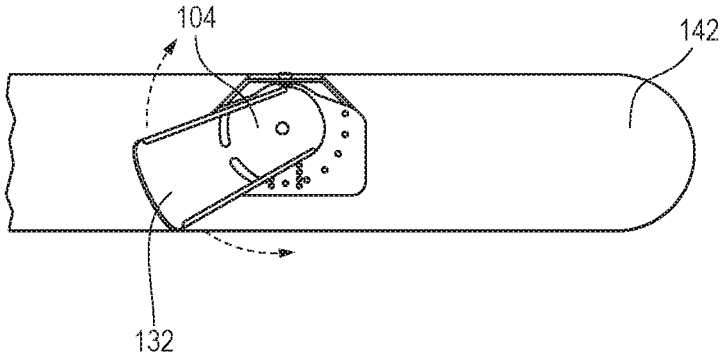
FIG. 7B is a top-side plan view of the base plate with the footbed selectively coupled thereto and positioned on a narrower snowboard which dictates a different angle relative to the lateral axis than in FIG. 7A.

FIG. 6 shows base plate 102 positioned on top of a relatively wide snowboard 140 and further shows a relatively narrower snowboard 142 in dashed line to illustrate the coupling of the base plate 102 to snowboards of differing widths. Regardless of the width of the snowboard, the pivot portion 112 is preferably positioned as close as possible to the heel side edge of the snowboard 114 without any overhang, but this is not absolutely required. FIGS. 7A and 7B are similar to FIG. 6, in that they show snowboards of differing widths, but also include the footbed 104 and show how the footbed 104 may be positioned at various selected angles relative to the lateral axis of the snowboard. For example, FIGS. 7A and 7B show how the footbed 104 may be positioned at the smallest possible angle relative to the lateral axis of the snowboard without the toe portion 132 of the footbed 104 overhanging the edge of the relatively wide snowboard 140 or the relatively narrow snowboard 142. In addition to avoiding overhang of the footbed 104, the angle of the footbed 104 may be adjusted to avoid overhang of a toe portion of the rider's boots. Thus, the length of the footbed 104 is not the only factor affecting the angle at which the footbed 104 can be configured.

The pivot portion 112 and elongate arm member 106 will be discussed in greater detail with respect to FIGS. 1-4. As described above, the elongate arm member 106 is configured to be pivotably coupled to the pivot portion 112 of base plate 102 to permit rotation thereof along a pivot axis P (shown in FIGS. 2 and 3), as described in further detail herein. As shown in FIG. 4, the pivot portion 112 includes an aperture 110 to which the elongate arm member 106 may be pivotably mounted. The hole 110 as illustrated in the example shown is substantially centered on the pivot portion 112 of the base plate 102 and is located vertically in approximate alignment with the ankle joint of a typical rider. Other positions for the hole are contemplated, including forward and rearward of the center of the base plate 102, or higher or lower on the pivot portion 112. As shown in FIG. 4, the elongate arm member 106 includes a first end portion 109 having an aperture 111 and a second end portion 107 having one or more apertures 146. The aperture 111 of the elongate arm member is configured to be aligned with an aperture 110 of the pivot portion 112 such that a pin, screw, bolt, or other similar structure (not shown) may be inserted through the apertures to permit the elongate arm member 106 to rotate about a pivot axis of the pivot portion 112. Additionally or alternatively, the first end portion 109 of the elongate arm member 106 having aperture 111 may be coupled to the pivot portion 112 via one or more bearings to reduce friction between the pivot portion 112 and the elongate arm member 106 while the elongate arm member 106 is permitted to rotate about the pivoting axis.

Figure 8A:
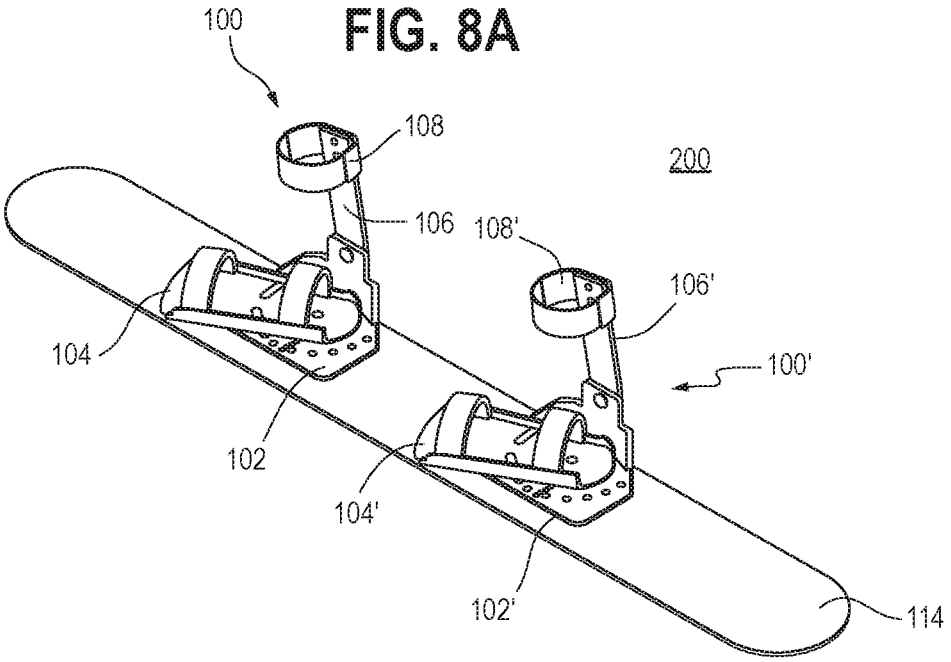
FIG. 8A is a perspective view of an example binding system for a snowboard, showing first and second binding apparatuses each including a base plate, a footbed selectively coupled to the base plate, an elongate arm member pivotably coupled to the base plate, a cuff member coupled to the upper portion of the elongate arm member, and straps for securing a rider's leg thereto.

As illustrated and described further below with respect to FIGS. 8A-8C, different elongate arm members providing various angles relative to the vertical axis or the amount the elongate arm members are angled inwardly may be selected and coupled to pivot portion 112 to provide further adjustment variety, including reversing a selected elongate arm member 106 to allow it to be angled outwardly. This helps to accommodate the anatomy or preferences of an individual rider. For example, some riders are naturally bowlegged or prefer a stance that places their knee outward or inward relative to the snowboard. For a given rider, this preference will likely change as boot angles relative to the lateral axis of the snowboard 114 change as dictated by the width of the selected snowboard.

In alternate examples, a separate knuckle member (not shown) may be provided to allow flexible offset or angling of the elongate arm member 106 relative to the pivot portion 112 and the pivot axis P on the binding apparatus 100. Examples of such a knuckle member are disclosed below in the context of the other embodiments disclosed herein, such as FIGS. 13-15.

In addition, the length of the elongate arm member 106 can be designed to accommodate the specific anatomy and preferences of particular riders. For example, by increasing the length of the elongate arm member 106, the cuff member 108 can be positioned directly on the rider's leg and just below the rider's knee. This position improves comfort by increasing the leverage applied to the snowboard edge and therefore reducing the force exerted by the cuff member 108 against the rider's leg. Relative even to known hard ski-type snowboarding boots, this configuration advantageously maintains the rider's leverage on the snowboard while increasing comfort because smaller forces are transmitted through the cuff member 108 than would be transmitted at the top of a ski-type boot, which often rests near the middle of the rider's shin. Specifically, the longer the distance between the snowboard and the connection point where force is applied to the snowboard edge, the less input force is required on the lever (in this case the rider's leg) to achieve the same amount of force acting on the edge of the snowboard. Riders may also prefer different lengths of the elongate arm member 106 depending on the type of riding they intend to engage in. Riders engaging in freestyle and all-mountain riding may desire less leg support and increased freedom of movement, and therefore a shorter elongate arm member 106 may be preferred, relative to riders engaged in alpine carving, which requires maximum leg support such that a rider may prefer a correspondingly longer elongate arm member 106.

In addition, as described above, the length of the elongate arm member 106 may be adjustable to accommodate users with legs of varying length. For a taller user, the elongate arm member 106 may be configured to be of a longer length so the cuff member 108 coupled thereto is positioned at a desired portion of the user's leg (e.g., near the upper portion of the calf). In some forms, the elongate arm member 106 may be formed having a telescoping locking structure such that its length may be extended or shortened and locked into place via biased locking pins or other fastening means by the rider (shown in FIG. 10A). Alternatively, the elongate arm member 106 may be detached from the pivot portion 112 and an elongate arm member of a differing length may be selected and attached instead. Alternatively, the elongate arm member 106 can be adjusted to be shorter to align the cuff member 108 with the top of a typical soft snowboard boot. In this configuration, the cuff member 108 has less leverage on the snowboard and would therefore place greater force against the rider's leg, but would still have the other advantages described elsewhere herein.

Example operation of the binding apparatus 100 illustrated in FIGS. 1-4 will now be described with respect to a rider snowboarding. The rider may first attach the base plate 102 of the binding apparatus 100 to the snowboard 114 by aligning the apertures 136 of the base plate 102 with apertures 138 of the snowboard and use a fastener, such as a screw or bolt, to secure the base plate 102 thereto at a desired position. The rider may then selectively couple the footbed 104 to the base plate 102 at a desired angle by aligning arcuate apertures 116 and hole 120 on the footbed 104 with apertures 118 and hole 122 respectively at a selected angle relative to the lateral axis of the snowboard 114, and inserting a fastener respectively therethrough. Then, the rider may then selectively couple a boot to the footbed by using known fastening means. For example, the boot may be attached to the footbed 104 via straps 124 and 126, clips, ratchets with ladders, or the like to securely couple the boot of the rider to the snowboard. Alternatively, internal bindings that connect to the bottom of the snowboard boot can also be used. Such devices are generally known and would be readily apprehended by persons skilled in the art. The rider may then position the cuff member 108 to at least partially surround a portion of the rider's leg such as the rider's calf. In embodiments of the cuff member 108 including straps such as strap 128, the straps may thereafter be secured around the rider's leg to inhibit removal from the cuff member 108 while snowboarding. While the rider is snowboarding, the elongate arm member 106 pivotably coupled to the pivot portion 112 of the base plate 102 rigidly supports the rider's leg, inhibits movement of the rider's leg in the direction of the lateral axis of the snowboard 114, and permits movement fore and aft of the lateral axis of the snowboard 114 for improved comfort, weight transfer, and snowboard control.

Additionally, various types of boots may be coupled to the footbeds provided herein such as a traditional soft snowboard boot, a modified shorter version of a traditional soft snowboarding boot, a hiking boot, a mountaineering boot, and the like, while still provided the advantages described herein. In conventional soft boot bindings, much of the leverage (e.g., for a toe side turn) is created by the rider pressuring his/her toes thereby applying a lifting force to the rider's heel and ankle strap. Occasionally, the rider's heel may begin to slip, which is colloquially known as "heel slip." In contrast, example binding apparatuses of the present disclosure alter the form in which leverage may be applied to a snowboard edge (e.g., via the elongate arm member) which thereby inhibits heel slip and/or the effects thereof, and permits a variety of different boot types to be coupled to the footbeds described. For example, the binding apparatuses disclosed herein may be advantageous to those engaged in backcountry snowboarding because they are able to wear the same boot type for both hiking and snowboarding (i.e., a hiking or mountaineering boot) which reduces the amount of weight that they may be otherwise required to carry. Further, if a backcountry enthusiast chooses to utilize mountaineering boots with the example binding apparatuses, then in between rides, the rider can make use of crampons more securely and/or more easily kick steps into slopes when compared to conventional soft boots. In addition, the binding apparatus is also advantageous to those who prefer a more comfortable boot for walking or hiking in addition to snowboarding.

Figure 8B:
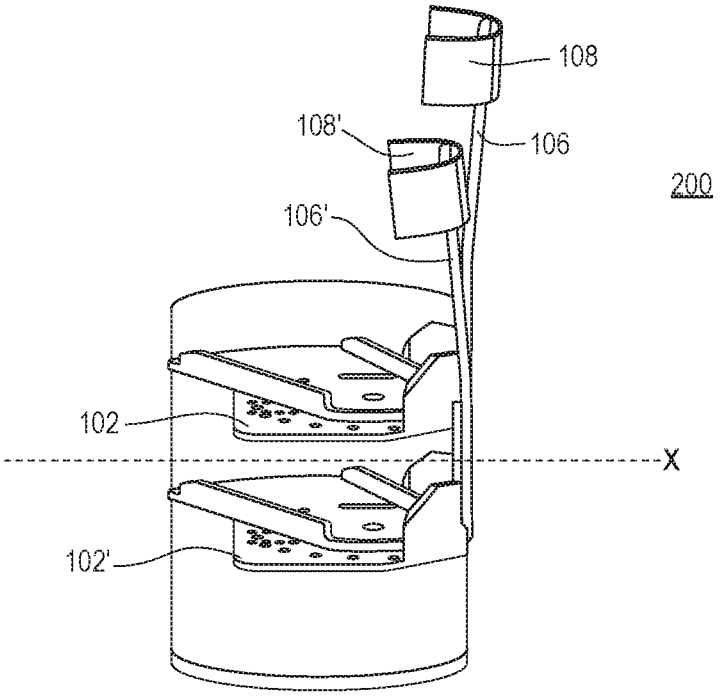
FIG. 8B is a perspective view of the binding system of FIG. 8A from the tail of the snowboard, showing the elongate arm member of the first binding apparatus angled inwardly and the elongate arm member of the second binding apparatus angled outwardly relative to a longitudinal axis of the snowboard.
Figure 8C:
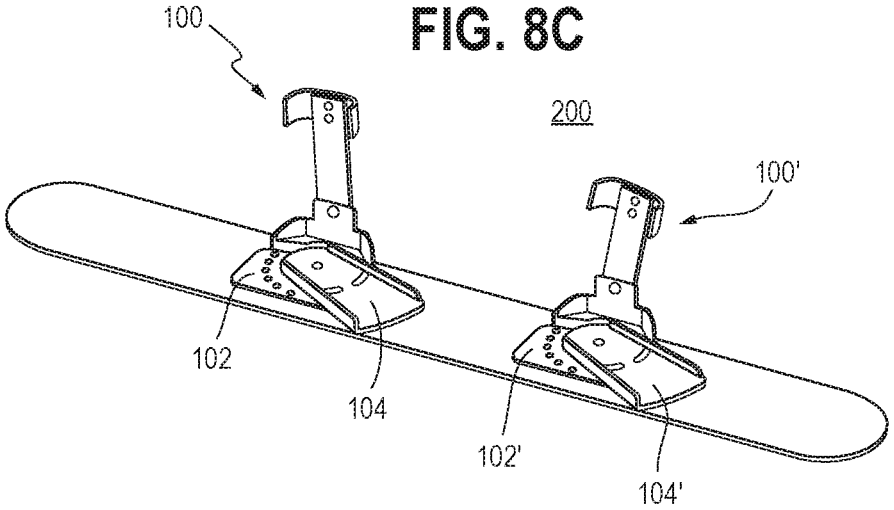
FIG. 8C is a perspective view of the binding system of FIG. 8A, showing the first and second binding apparatuses coupled to the snowboard, and further showing the footbeds rotated towards an opposite side of the snowboard.

Referring now to FIGS. 8A-8C and 9, a boot binding system 200 for a snowboard is shown including a first binding apparatus 100 and a second binding apparatus 100'. For clarity and ease of discussion, the second binding apparatus 100' is substantially similar to the first binding apparatus 100 such that any differences will be highlighted hereinafter. The base plates 102, 102' of the first and second binding apparatuses 100, 100' may be attached the snowboard, and each binding apparatus 100, 100' is configured to receive a leg of the rider as described in detail above. So configured, the first and second binding apparatuses 100 selectively couple the rider's legs to the snowboard as described in detail with respect to the binding apparatus 100. Additionally, as described above, each binding apparatus 100, 100' may include a different elongate arm member having a different angled configuration. That is, the elongate arm member 106 of the first binding apparatus 100 may be angled inwardly in the direction of the lateral axis X of the snowboard 114, and the elongate arm member 106' of the second binding apparatus 100' may be angled outwardly in the direction of the lateral axis of the snowboard 114 as shown in FIG. 8B. In alternative forms, the angled configuration of the elongate arm member 106 may be configured such that the first binding apparatus 100 is outwardly angled in the direction of the lateral axis X of the snowboard 114 and the elongate arm member 106' and the second binding apparatus 100' is inwardly angled. In further alternative forms, both elongate arm members 106, 106' may be angled in the same inward or outward direction.

As described above, and illustrated in FIG. 8C, the footbeds 104, 104' can be configured for riders preferring a "regular" stance, i.e., one in which the left foot is favored to be the lead leg when sliding across the snow. This is in contrast to the same binding system shown in FIG. 8A, which is configured to accommodate a rider preferring a "goofy" stance, one in which the right foot is favored to be the lead leg when sliding across the snow. The binding system 200 can also accommodate riders preferring a "duck" stance in which one foot is at a positive angle in relation to the lateral axis of the snowboard and the other foot is at a negative angle in relation to the lateral axis of the snowboard. So configured, binding system 200 permits the user to adjust various components of each binding apparatus 100, 100' to provide extensive customization options.

Referring again to FIG. 8A, the forward-to-rearward (tip-to-tail) movement provided by the elongate arm members 106, 106', which is controllable via the rider's legs engaging with the cuff members 108, 108' provides the rider greater control for weight transfer and for delivering force to the snowboard edge while snowboarding. So configured, the binding system 200 permits a rider to selectively couple their boots to the snowboard 114 via the footbeds 104, 104' at an angle relative to the lateral axis of the snowboard while still allowing forward-to-rearward (i.e., tip-to-tail) movement via the elongate arm members 106, 106' and cuff members 108, 108' which would otherwise be inhibited using typical, known hard boots.

Properly configured, the binding system 200 allows the rider's legs to move freely in a tip-to-tail motion, but restricts movement of the rider's leg laterally in relation to the snowboard 114, either in a movement toward the toe side edge of the snowboard 114, or toward the heel side edge of the snowboard 114. Importantly, unlike prior soft boot high-back bindings, the boot binding system 200 does not restrict movement of the high-back along the longitudinal direction of the snowboard 114. Thus, the boot binding system 200 differs in form and function from known high-back designs because it allows freedom of motion along the longitudinal length of the snowboard 114 and therefore does not necessarily brace the rider's leg in a strictly heelward direction (i.e., relative to the foot). Further, the direction of pivot in existing high-backs is always relative to the rider's foot such that the pivot angle is necessarily misaligned relative to the snowboard when the rider selectively adjusts the angle of the binding relative to the snowboard. In contrast, the binding system 200 described herein may remain directly aligned with the longitudinal axis of the snowboard regardless of the orientation of the footbed relative to the snowboard.

Figure 9:
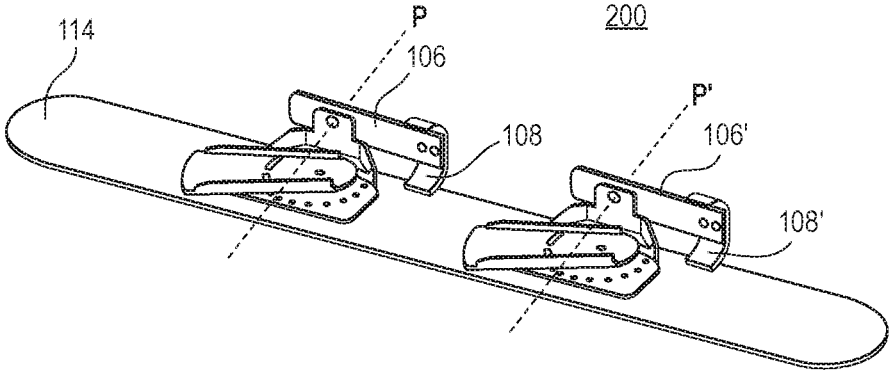
FIG. 9 is a perspective view of the binding system of FIG. 8A, showing the elongate arm members of the first and second binding apparatuses fully pivoted towards a tail of the snowboard for transportation and/or storage and chairlift loading.

Referring now to FIG. 9, because the pivot axis P, P' of each elongate arm member 106, 106' is substantially aligned with the lateral axis of the snowboard, the elongate arm members 106, 106' and associated cuff members 108, 108' may be configured to fold along the length of the snowboard 114, for example in a rearward direction toward the tail of the snowboard 114. This advantageously allows the device to fold substantially flat when not in use (e.g., when a rider is loading and riding on a chairlift, when the snowboard is placed on a rack at the lodge or on a car, or when the snowboard is packed into a snowboard carrying bag for travel). Further, the orientation of the pivot axis P prevents the elongate arm member 106 from extending substantially outward from the snowboard in the lateral direction, keeping it substantially within the bounds of the top surface of the snowboard even when folded flat. In contrast, taller high-back binding designs are often limited because the high-back folds along an axis parallel to the footbed of the binding. When folded flat, such a high-back binding could fold forward and extend outward beyond the edge of the snowboard if the high-back is taller than the width of the snowboard and bindings are mounted at shallow angles relative to the lateral axis of the snowboard.

Figure 10A:
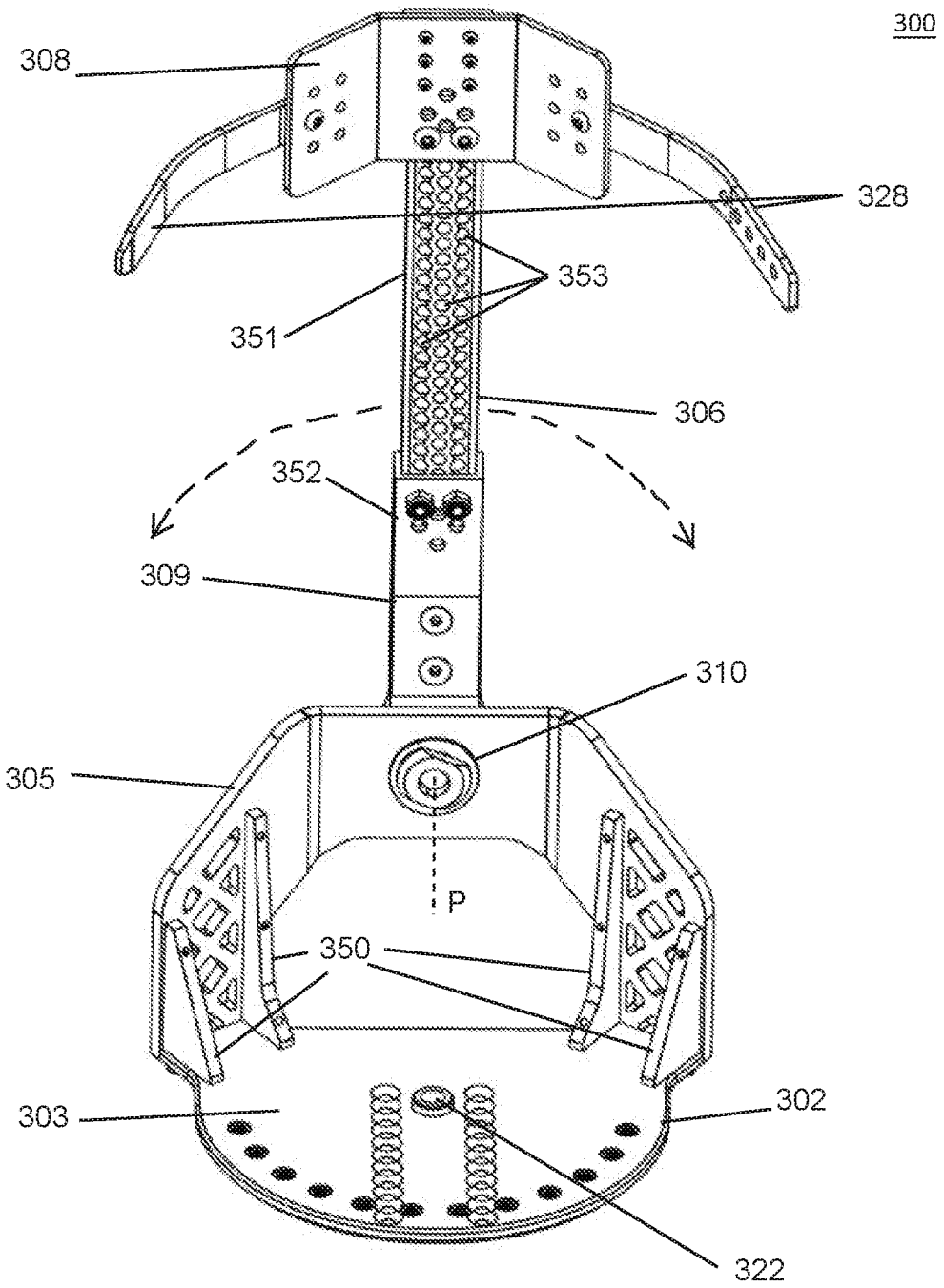
FIG. 10A is a front perspective view of another example binding apparatus having a base plate, an adjustable elongate arm member pivotably coupled to a portion of the base plate, and a cuff member coupled to an upper portion of the elongate arm member.
Figure 10B:
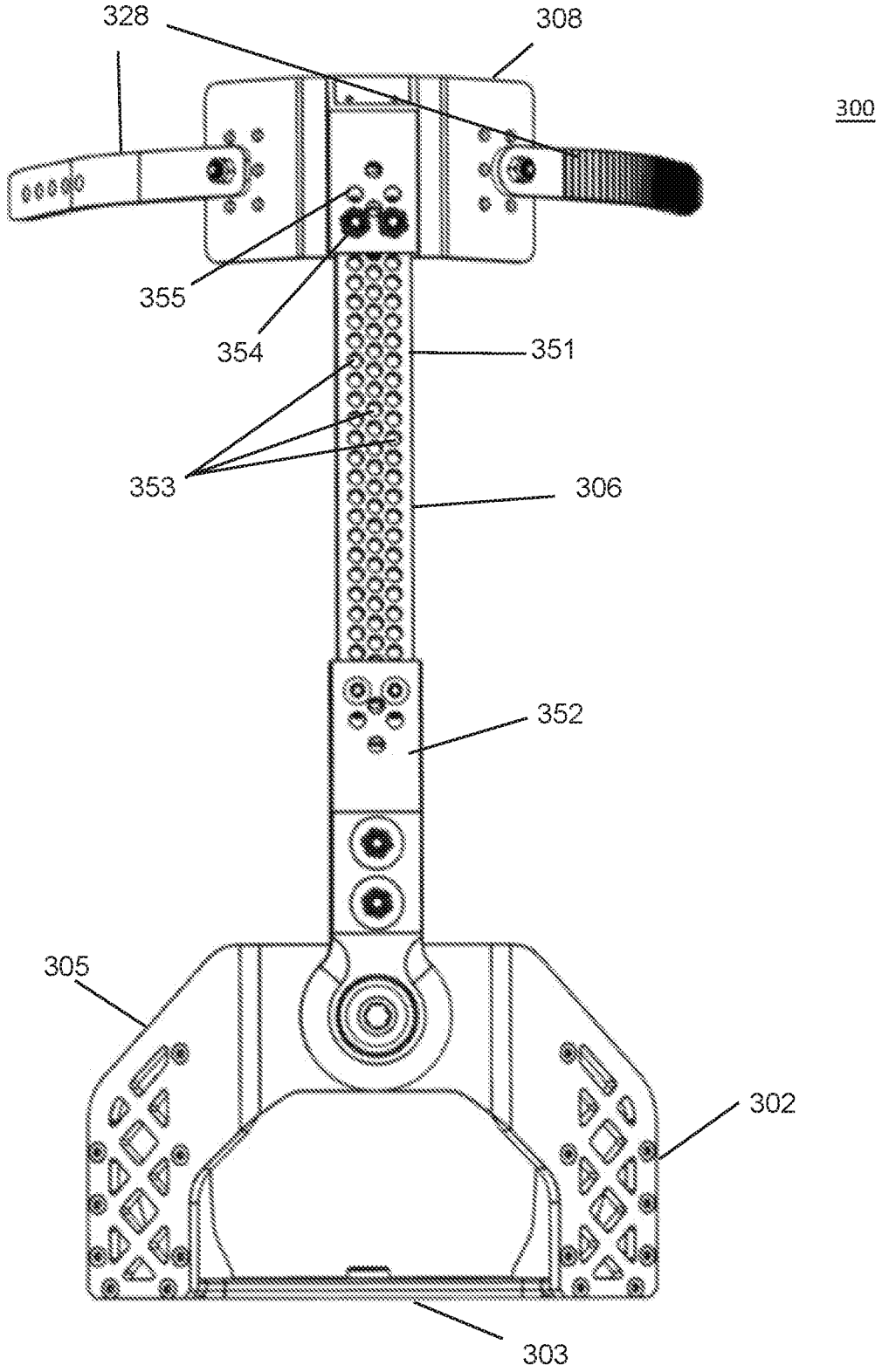
FIG. 10B is a rear elevational view of the binding apparatus of FIG. 10A showing an opposite side thereof.
Figure 11:
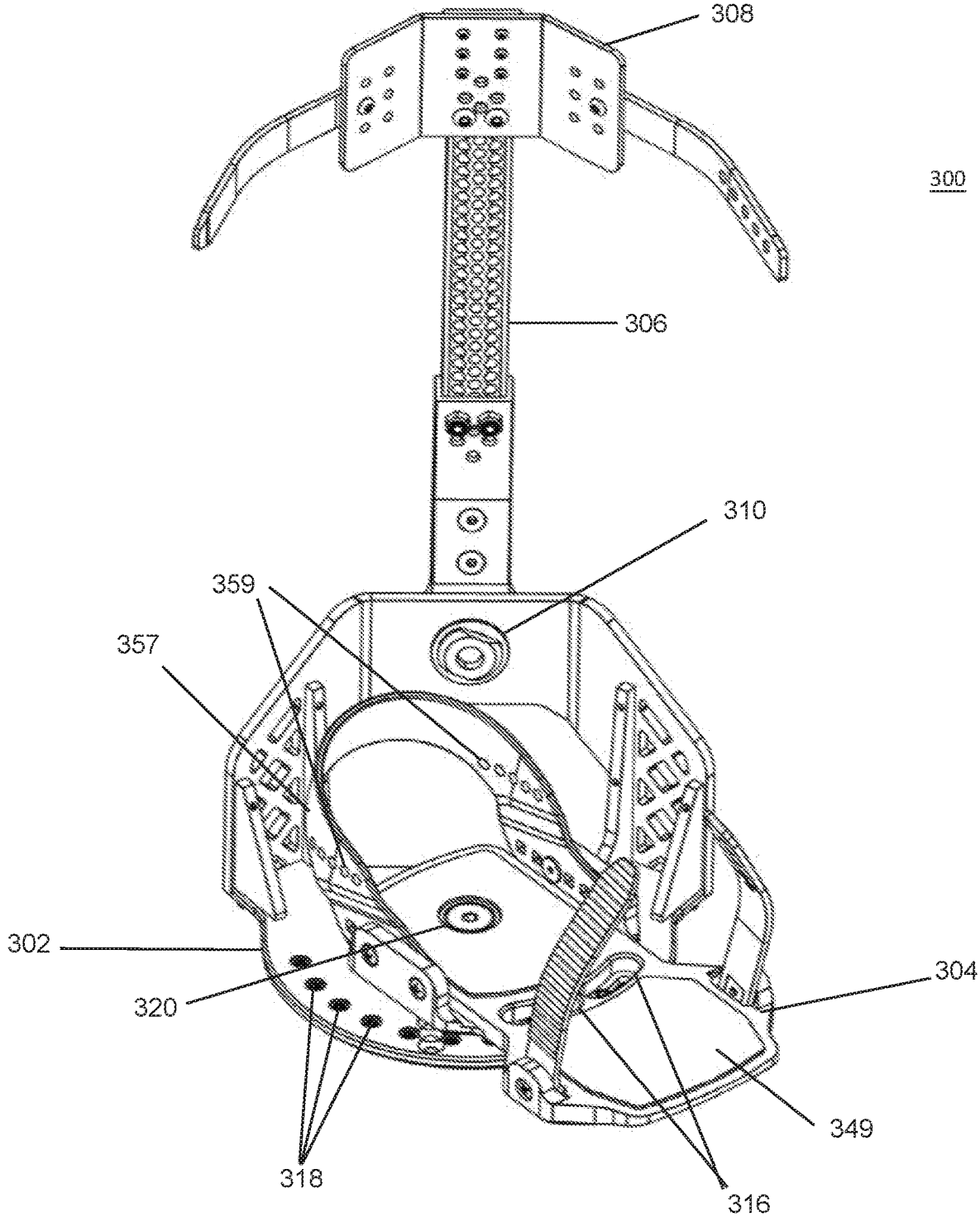
FIG. 11 is a front perspective view similar to FIG. 10A, showing an example footbed selectively coupled to the base plate.

Referring now to FIGS. 10A, 10B, and 11, an alternative embodiment of a binding apparatus 300 is shown that is similar to the binding apparatus 100 such that the discussion of components with respect to binding apparatus 100 are equally applicable unless otherwise described herein. As illustrated in FIG. 10A, binding apparatus 300 includes a base plate 302, an elongate arm member 306 pivotably coupled to the base plate 302 at a first end portion 309 thereof, and a cuff member 308 coupled to a second end of the elongate arm member 306. The binding apparatus 300 further includes footbed 304 (shown in FIG. 11) that is configured to be coupled to the base plate 302 in a similar, pivotable manner as described above with respect to footbed 104 and base plate 102.

As illustrated in FIG. 10A, the base plate 302 can be comprised of two main components. For example, the base plate 302 may be formed of a flat base portion 303 that is configured to be mounted to the snowboard and to which the footbed 304 may be coupled, and a pivot mount 305 which may affixed to the base portion 303 and includes an aperture 310 to which the elongate arm member 306 is pivotably coupled to. In the illustrated form, the base portion 303 and the pivot mount 305 are secured to each other and/or reinforced using a plurality braces or struts 350 each with appropriate fasteners. In some forms, there may be two braces on each side of the pivot mount 305, and the braces may be of different sizes, configurations, or materials. In such an embodiment, the flat base portion 303 advantageously uses less material, which makes it lighter and also less expensive to manufacture. The pivot mount 305 may be constructed in an arcuate shape as shown in FIG. 10A which exposes an opening underneath the location of the pivot. This opening advantageously allows clearance for the heel of the boot of a rider to get as close as possible to the heel side edge of the snowboard, thus reducing the boot angle relative to the lateral axis of the snowboard on a given width snowboard, which improves rider's stability, without causing the riders boot to overhang off the board.

As illustrated, the height/length of the elongate arm member 306 can be adjustable both telescopically by moving a first end portion or upper portion 351 of the elongate arm member into a second end portion or lower portion 352 of the elongate arm member 306, and also at the cuff member 308, by way of varying fastener configurations. For example, the elongate arm member 306 may include a plurality of apertures 353 extending therethrough for receiving fasteners to couple both the upper portion 351 to the lower portion 352 and permit the adjustability described above. Further, the apertures 353 may permit the cuff member 308 to be secured to the upper portion 351 of the elongate arm member 306 at varying heights. This allows for a rider to adjust for their own particular anatomy, i.e., if the rider has long or short legs, and also adjust for various riding styles. For example, as previously described, the length of the elongate arm member 306 may be adjusted so that the cuff member 308 is positioned just below the rider's knee and is affixed directly to the rider's leg. This configuration will provide for improved control and an increased ability to exert force on the edge of the snowboard. In addition, as discussed above, the upper portion 351 and/or the lower portion 352 of the elongate arm member 306 may be replaced with other upper or lower portions having varying lengths to accommodate a rider's anatomy or preferences. In another described example, the elongate arm member 306 may be positioned at such length so that the cuff member 308 is positioned around the top of the rider's traditional soft boot to allow for the more flexibility for freestyle or highly variable terrain. To further enhance this flexibility, the cuff member 308 can be lowered to a lowest position via the adjustment of the elongate arm member 306 or adjustment of the cuff member 308, and further the cuff strap 328 can be removed altogether. This configuration would permit improved flexibility for use in, for example, terrain parks and acrobatic jumping. In some embodiments, the cuff member 308 itself is affixed to the rider's leg or rider's boot using strap 328 known in the field which may include a traditional ratchet with ladder. There are various apertures in the cuff member 308 which allow a rider to adjust the height or angle of the strap.

As shown in FIG. 11, the footbed 304 is of a different configuration than the footbed 104 and is shown including two components, i.e., a bottom portion 349 of the footbed 304 and a heel loop 357. The bottom portion 349 of the footbed 304 has an aperture or hole 320 similar to hole 120 described above that allows the footbed 304 to be rotated thereabout and selectively positioned at a desired angle, and the footbed 304 may also include one or more apertures in the form of arcuate slots 316 corresponding with apertures 318 of the base plate 302 to selectively secure the footbed 304 at the desired angle. The footbed 304 may also include a heel area inset pad and a toe area inset pad. These pads allow a rider to get a snug fit when tightening the ratchets with ladders on both the ankle strap and on the toe strap. The heel loop 357 may be mounted at a rear end of the bottom portion 349 of the footbed 304. On the heel loop 357, various mounting apertures 359 for coupling to an ankle strap are shown. The heel loop 357 is configured to inhibit the rider's boot from sliding backward in relation to the footbed 304 and likewise provides something for an ankle strap to pull against for a snug fit. However, it should be understood that the various components of binding apparatus 300, such as the footbed 304, may likewise be used in connection with the components of the binding apparatus 100, and vice versa. So configured, the components described herein of the various binding apparatus may be interchangeable and used with one another to provide even further customization options.

Figure 12A:
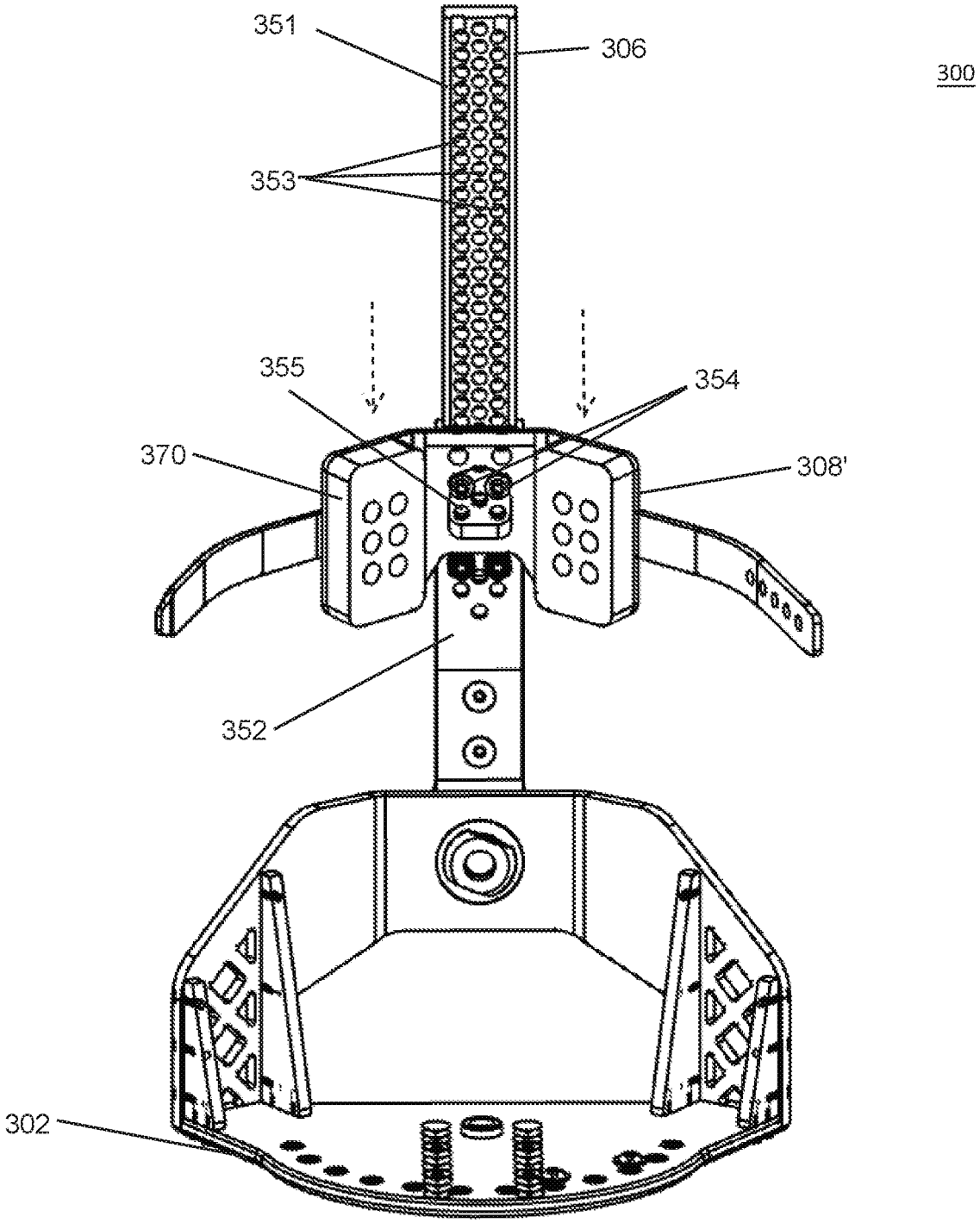
FIG. 12A is a front perspective view of the binding apparatus of FIG. 10A showing an alternative cuff member selectively coupled to different apertures of the elongate arm member to adjust the height of the cuff member.
Figure 12B:
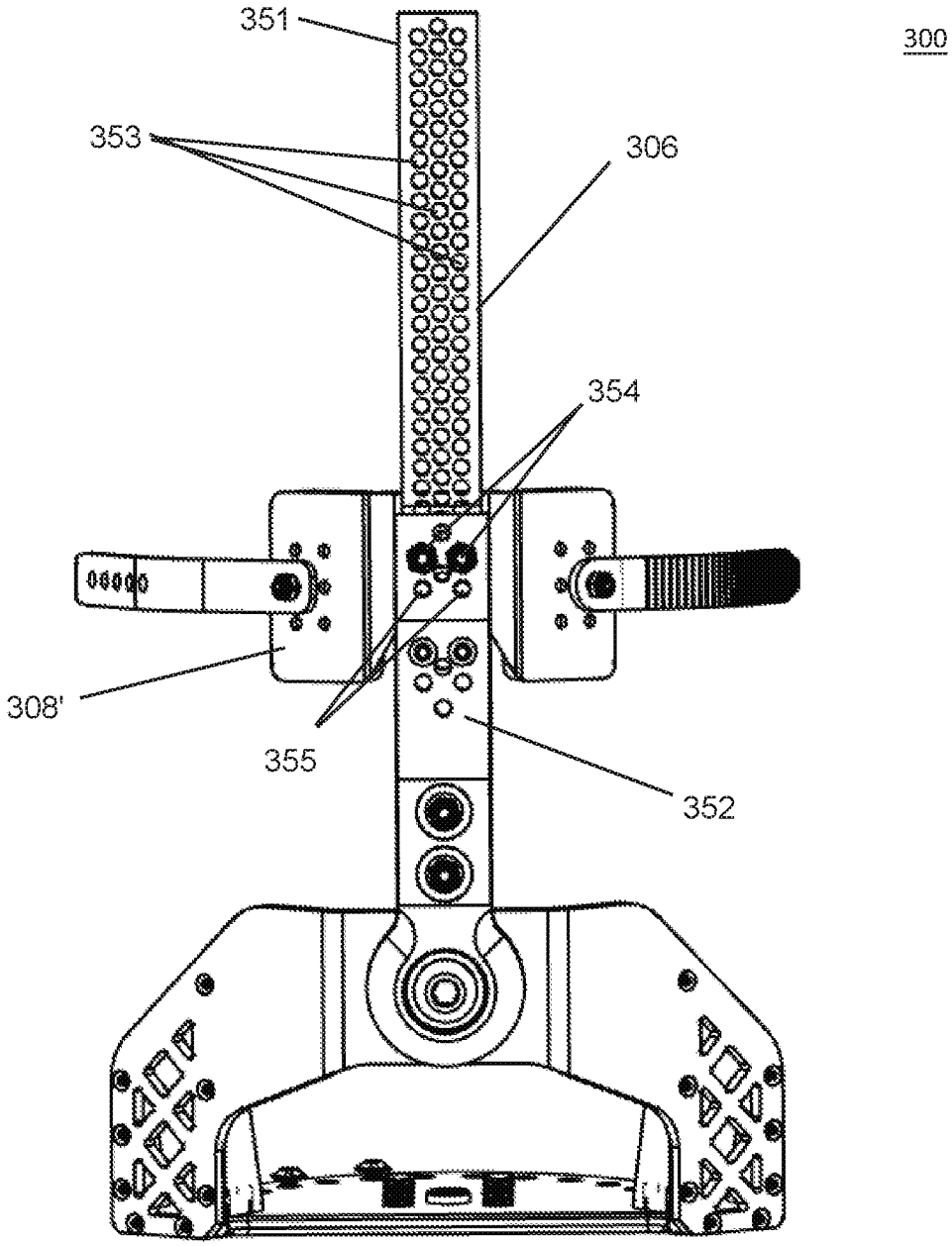
FIG. 12B is a rear elevational view of the view of FIG. 12A showing an opposite side of the binding apparatus.

As described above, and illustrated in FIGS. 12A and 12B, the apertures 353 may permit the cuff member to be secured to the upper portion 351 of the elongate arm member 306 at varying heights. As shown in FIG. 12A, a cuff member 308' (substantially similar to cuff member 308, but including padding 370 increasing the thickness thereof) is coupled to the elongate arm member 306 near the lower portion 352 thereof. The cuff member 308' includes openings 355 that may be axially aligned with selected apertures 353 of the upper portion 351 of the elongate arm member 306, such that a fastener (e.g., the illustrated bolt 354, a locking pin, spring loaded pin, or the like) may be advanced therethrough to secure the cuff member 308' to the elongate arm member 306 at different heights. So configured, a rider may adjust the height of the cuff member 308' by removing the fasteners 354, sliding the cuff member 308' to a selected height along the elongate arm member 306, aligning the openings 355 with the apertures 353, and advancing one or more fasteners therethrough to secure the cuff member 308' at the new selected height. This allows for a rider to adjust for their own particular anatomy, i.e., if the rider has long or short legs, and also adjust for various riding styles. Other means of adjustment could be used, as would be recognized by persons skilled in the art. For example, a clamping mechanism, such as a quick release clamp, could secure the cuff member 308' at a selected height by clamping the sides of the upper portion 351 of the elongate member 306, allowing the cuff member 308' to slide freely along the upper portion 351 when the clamping mechanism is released. Alternatively, slots or detents within the upper portion 351 could receive a pin or other projection to secure the cuff member 308' at the desired height.

Figure 13:
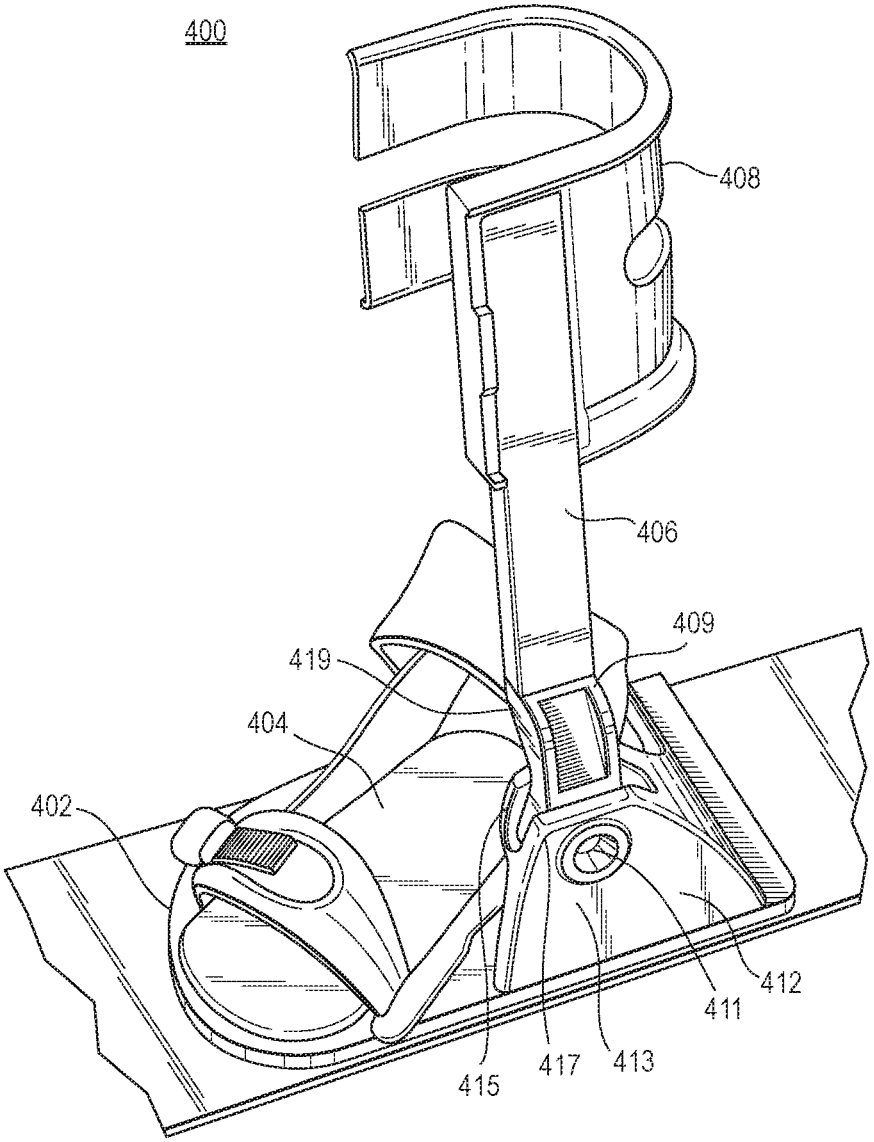
FIG. 13 is a perspective view of yet another example binding apparatus for a snowboard having a base plate with a pivot portion, a footbed, an inwardly angled elongate arm member pivotably coupled to the pivot portion via a knuckle member, and a cuff member coupled to an opposite end of the elongate arm member.
Figure 14A:
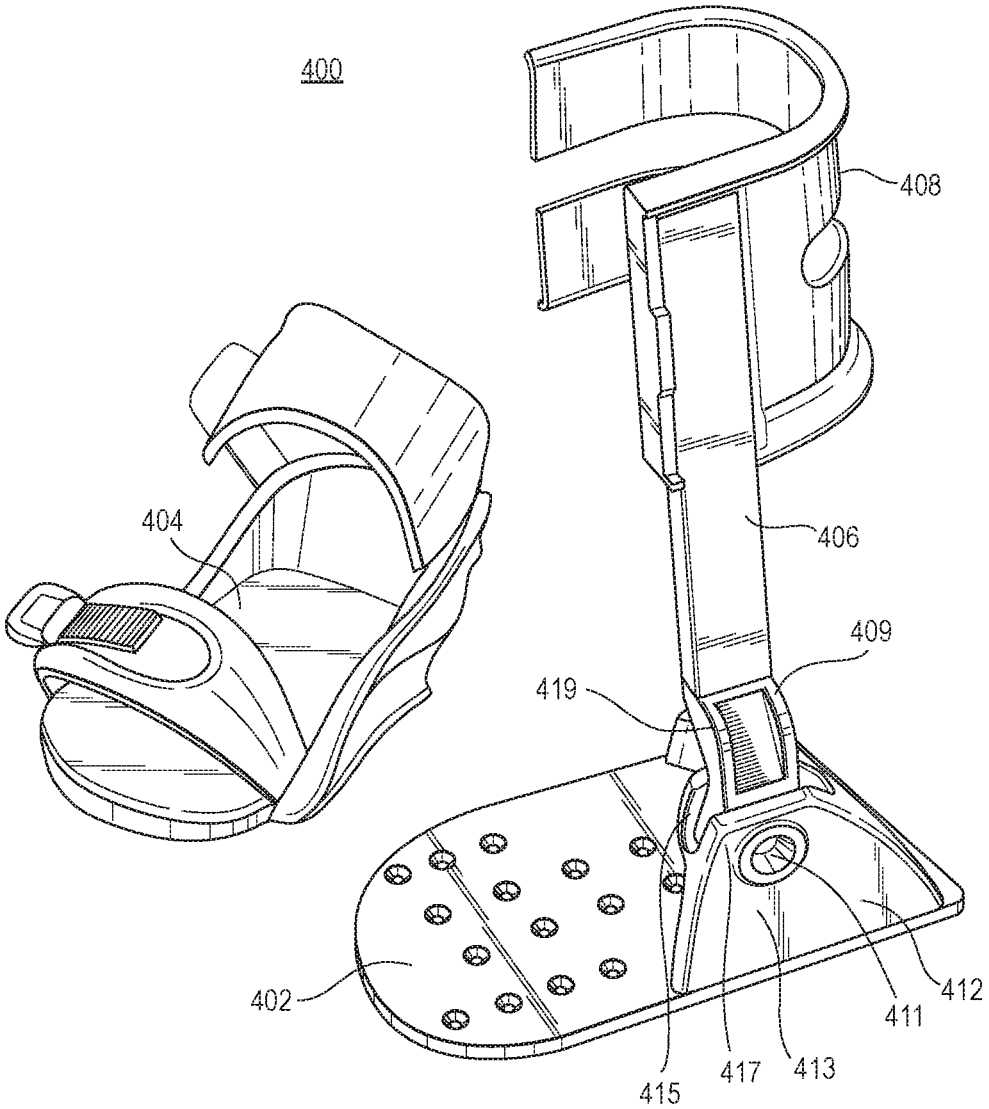
FIG. 14A is a perspective view of the binding apparatus of FIG. 13 with the footbed removed, showing apertures in the base plate for receiving fasteners to secure the base plate to the snowboard.
Figure 15:
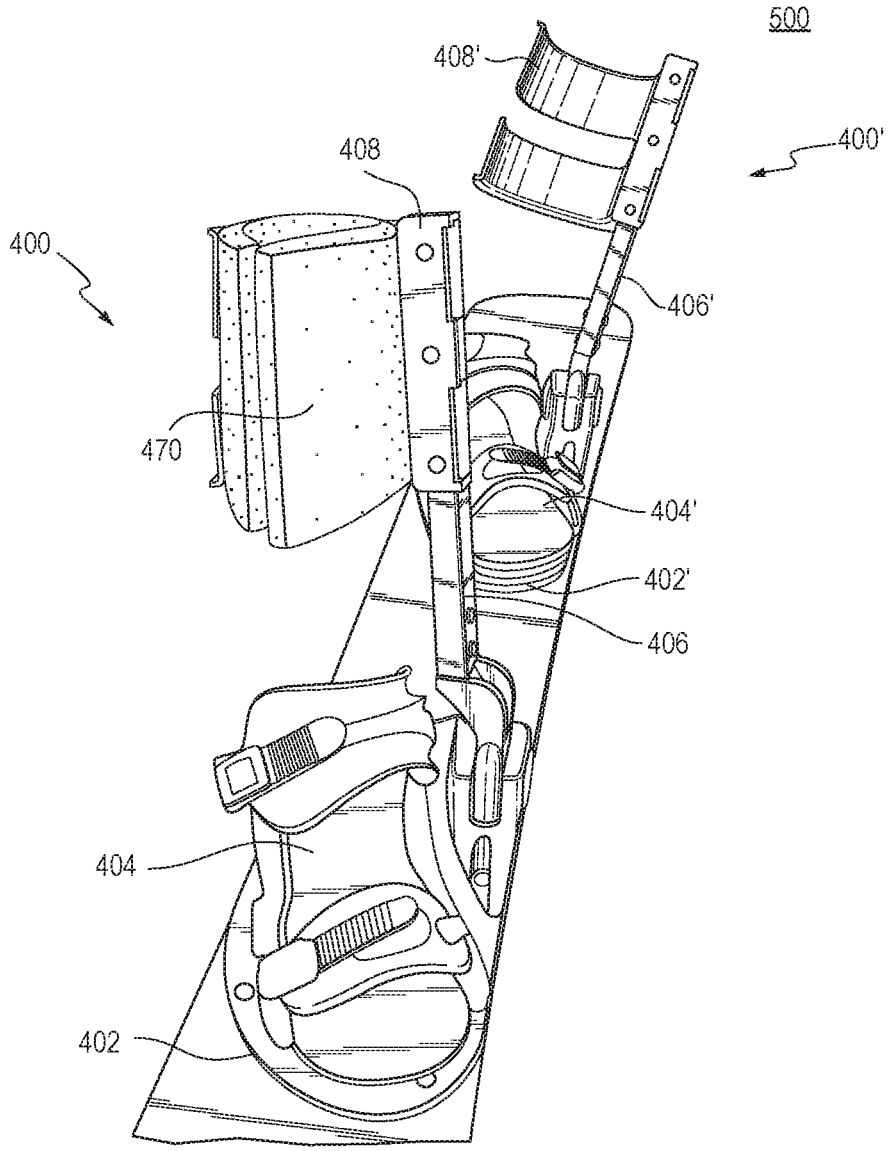
FIG. 15 is a perspective view of another example binding system for a snowboard, showing a snowboard, a first binding apparatus, and a second binding apparatus, where each binding apparatus includes a base plate having a pivot portion and a footbed, an elongate arm member pivotably coupled to the pivot portion, and a cuff member coupled to an opposite end of the elongate arm member.

Referring now to FIGS. 13 and 14A, yet another alternative binding apparatus 400 is shown. The binding apparatus 400, is similar to the binding apparatus 100 such that the discussion above of components with respect to binding apparatus 100 are equally applicable unless otherwise described herein. As illustrated in FIG. 13, binding apparatus 400 includes a base plate 402, a footbed 404, an elongate arm member 406 pivotably coupled to the base plate 402 at a first end thereof, and a cuff member 408 coupled to a second end of the elongate arm member 406. Similar to the other embodiments provided herein, the elongate arm member 406 is configured to pivot forward and rearward long the longitudinal length of the snowboard (tip-to-tail) to permit a riders leg to pivot therewith for enhanced control over the snowboard.

As illustrated, the pivot portion 412 of the binding apparatus 400 includes a bracket 413 having a pair of opposing plate-like walls 415, 417 including apertures extending axially therethrough that may be substantially aligned with an ankle joint of the rider. A first end portion 409 of the elongate arm member 406 maybe include an aperture 411 corresponding with the apertures of the plate-like walls 415, 417 such that the apertures may be aligned and a pin or other fastener may be inserted therethrough to attach the elongate arm member 406 to the base plate 402.

As illustrated, the first end portion 409 of the elongate arm member 406 is in the form of a separate knuckle member 419 that is operatively coupled thereto. The knuckle member 419 is configured to offset the elongate arm member 406 relative to a vertical axis such that the elongate arm member 406 is positioned proximate or adjacent the rider's leg. As shown, the knuckle member 419 forming the first end portion 409 of the elongate arm member 406 is a separate piece that may be operatively coupled to the elongate arm member 406 via fastening means. So configured, different knuckle members having variable offset angles relative to the vertical axis may be utilized to adjust the amount the elongate arm member 406 is angled and provide further adjustment variety. Alternatively, the elongate arm member 406 and the knuckle member 419 may be of a unitary, monolithic construction. In further forms, the elongate arm member 406 may be detachable from the knuckle member 419 such that elongate arm members of other shapes, lengths, or sizes may be attached thereto.

Figure 14B:
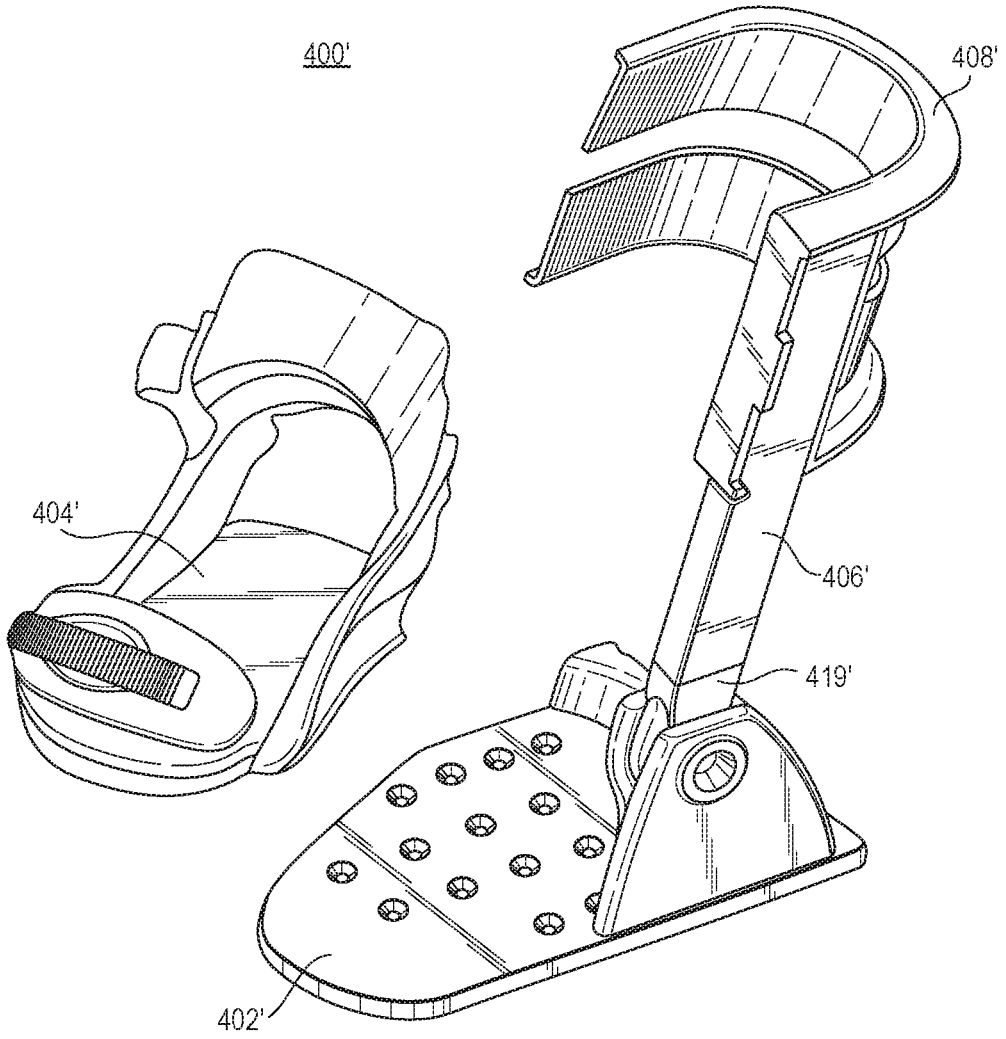
FIG. 14B is a perspective view of another example binding apparatus for a snowboard similar to FIG. 14A but having an outwardly angled elongate arm member relative to a longitudinal axis of the snowboard.

In additional forms, such as illustrated in FIG. 14B showing another binding apparatus 400', a knuckle member 419' may be provided to angle the elongate arm member 406' outwardly in the direction of the lateral axis of the snowboard. This helps to accommodate the anatomy or preferences of an individual rider. For example, some riders are naturally bowlegged or prefer a stance that places their knee outward or inward relative to the snowboard. For a given rider, this preference will likely change as boot angles relative to the lateral axis of the snowboard change as dictated by the width of the selected snowboard.

Referring again to FIG. 13, the cuff member 408 is of a generally arcuate U or C-shaped configuration having an opening for receiving the rider's leg within the opening of the C-shape. The cuff member 408 serves a substantially similar function as the cuff member 108 but is of an alternative shape and configuration as described herein. To inhibit the rider's leg from being removed from the cuff member 408 while snowboarding, one or more straps may be provided to secure the rider's leg therein. For example, a hook-and-loop strap, such as Velcro®, or ladders with ratchets as used in many snowboard binding applications may be used to wrap around the C-shaped cuff member 408 to close off the opening thereof and secure the rider's leg therein. The cuff member 408 may likewise be of a rigid or substantially rigid, resilient material to withstand the force imparted thereto by the rider's leg while the elongate arm member 406 is permitted to rotate about the pivoting axis while at the same time being able to flex enough to reduce the circumference for a snug fit. In some embodiments, the cuff member 408 may include an insert such as padding (e.g., foam padding 470) to improve the comfort of the rider while the rider's leg is positioned in the cuff member 408. For example, foam padding may be provided on the interior surface of the C-shaped cuff member 408 such that the rider's leg may be comfortably retained therein With respect to FIG. 15, a boot binding system 500 including both binding apparatus 400 (shown in FIG. 14A) and binding apparatus 400' (shown in FIG. 14B) is illustrated. Boot binding system 500 is substantially similar to boot binding system 200 except for the individual differences in the binding apparatuses 400, 400'. For example, as shown, the base plates 402, 402' of the first and second binding apparatuses 400, 400' may be attached the snowboard, and each binding apparatus 400, 400' is configured to receive a leg of the rider as described in detail above. So configured, the first and second binding apparatuses 400, 400' selectively couple the rider's legs to the snowboard as described in detail with respect to the binding apparatus 400. Additionally, as described above and shown in FIG. 15C, each binding apparatus 400, 400' may include a different elongate arm member having a different angled configuration. Optional foam padding 470 is shown positioned in the cuff member 408.

So configured, the forward-to-rearward (tip-to-tail) movement provided by the elongate arm members 406, 406', which is controllable via the rider's legs engaging with the cuff members 408, 408' provides the rider greater control for weight transfer and for delivering force to the snowboard edge while snowboarding. The binding system 500 permits a rider to selectively couple their boots to the snowboard via the footbeds 404, 404' at an angle relative to the lateral axis of the snowboard while still allowing forward-to-rearward (i.e., tip-to-tail) movement via the elongate arm members 406, 406' and cuff members 408, 408' which would otherwise be inhibited using typical, known hard boots. Properly configured, the binding system 500 allows the rider's legs to move freely in a tip-to-tail motion, but restricts movement of the rider's leg laterally in relation to the snowboard, either in a movement toward the toe side edge of the snowboard, or toward the heel side edge of the snowboard.

Figure 16:
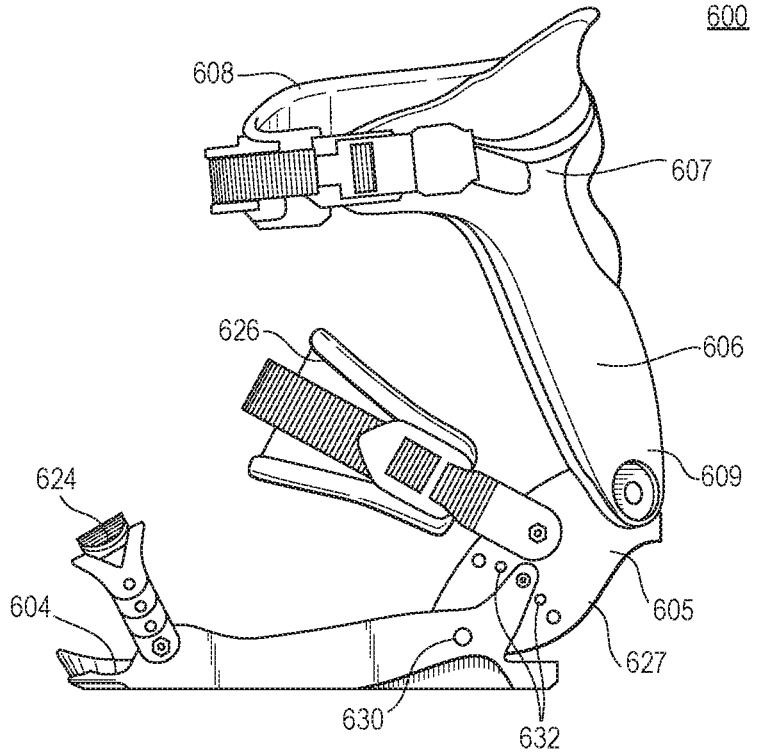
FIG. 16 is a side elevational view of another example snowboard binding apparatus showing a footbed, a pivoting heel cup, an elongate arm member pivotably coupled to an aperture of the pivoting heel cup, and a cuff member.
Figure 17:
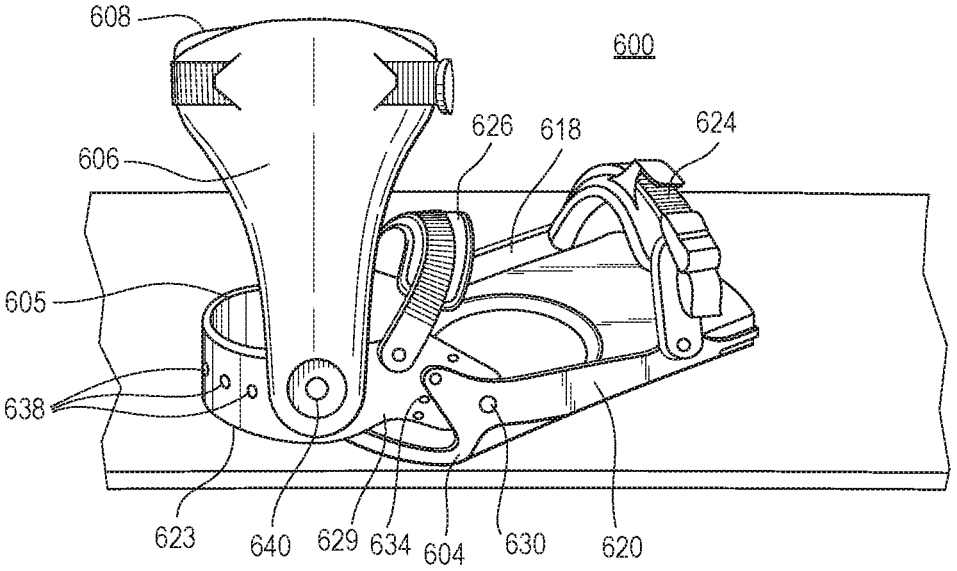
FIG. 17 is a perspective view of the binding apparatus of FIG. 16, showing the elongate arm member affixed to a different aperture of the pivoting heel cup and showing the binding apparatus coupled to a snowboard.
Figure 18:
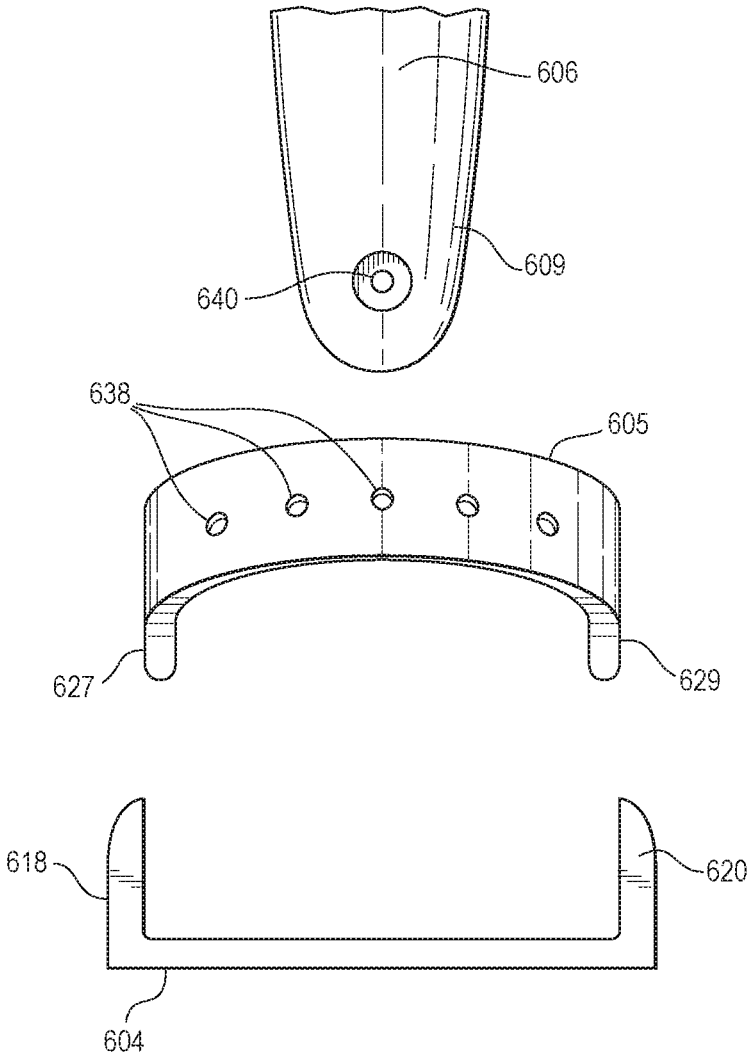
FIG. 18 is an enlarged, exploded view of a portion of the binding apparatus of FIG. 16 showing the footbed, pivot portion, and a first end of the elongate arm member for coupling to one of the apertures of the pivoting heel cup.

In further alternative embodiments, the tip-to-tail freedom of leg movement but restricted lateral leg movement can be accomplished using a modified high-back binding for soft boots or a modified hard boot as shown in FIGS. 16-18. Referring now to FIG. 16, an example binding apparatus 600 includes a footbed 604, a pivoting heel cup 605, an elongate arm member 606, and a cuff member 608. The pivoting heel cup 605 maybe be coupled to the footbed 604 and a first end or first end portion 609 of the elongate arm member 606 is pivotably coupled to an aperture of the pivoting heel cup 605, as described in more detail with respect to FIG. 18. As shown, the cuff member 608 is coupled to a second end or second end portion 607 of the elongate arm member 606, and the cuff member 608 is configured to selectively receive a portion of a user's leg in a manner similar to the other cuff members described hereinbefore. In this manner, the elongate arm member 606 and cuff member 608 similarly operate to transmit force applied by the user's leg to an edge of the snowboard. In some embodiments, the cuff member 608 may be formed integrally with the second end 607 of the elongate arm member 606. So configured, the binding apparatus 600 couples a rider's leg to the snowboard while allowing movement fore and aft of the lateral axis of the snowboard (tip-to-tail) and inhibiting movement in a lateral direction.

As illustrated in FIGS. 16 and 17, the binding apparatus 600 may include a toe strap 624 and an ankle strap 626, both comprising a locking mechanism to secure a snowboard boot to the footbed 604. For example, the locking mechanism may comprise a rachet and ladder locking strap, a clip, or other known securing structures. As shown, the ankle strap 626 is secured to the pivoting heel cup 605 of the binding apparatus 600. In alternative embodiments, the ankle strap 626 may be secured directly to the footbed 604. Alternatively, internal bindings that connect to the bottom of the snowboard boot can also be used. The footbed 604 as shown includes a first sidewall 618 and a second sidewall 620 extending upward from each side of the footbed 604 respectively to inhibit movement of the rider's boot once secured in the footbed 604.

As seen in FIG. 17, the pivot portion or pivoting heel cup 605 is of a generally arcuate U-shaped member 623 configured to receive a heel portion of a rider's boot. Each leg 627, 629 of the pivoting heel cup 605 includes an aperture 630 configured to be pivotably coupled to the first and second side walls 618, 620 respectively. Additionally, each leg 627, 629 of the U-shaped pivoting heel cup 605 may include a plurality of adjusting apertures 632, 634 respectively that are configured for adjusting the position and angle at which the heel cup 605 is coupled to the footbed 604. This adjustability allows the rider to change the desired amount of forward lean provided by the heel cup 605. Further, the pivot axis (aligned and coaxial with the hole 640) of the elongate arm member 606 is capable of being adjusted to a location that aligns with the rider's ankle joint. For example, as shown the adjusting apertures 632, 634 are configured to align with apertures of the first and second sidewalls 618, 620 of the footbed 604 respectively such that any of the adjusting apertures 632, 634 may be selected and coupled to the first and second sidewalls 618, 620 to position the pivoting heel cup 605 at a desired position and angle. In operation, the pivoting heel cup 605 may pivot via each leg 627, 629 coupled to the first and second sidewalls 618, 620 and the rider may then align and couple the adjusting apertures 632, 634 with apertures of the first and second sidewalls 618, 620 via a biasing pin or other similar locking structure. So configured, the pivoting heel-cup 605 itself may be locked at a desired position and angle. In another variation, the modified high-back can be set up by the rider without using any locking pin or bolt which would allow free movement of the lower leg of the rider in any direction except toward the heelside edge of the snowboard. In further alternative embodiments, the heel cup 605 is fixed relative to the first and second sidewalls 618, 620, but the elongate arm member 606 may include a mechanism for adjusting the forward lean of the high-back at a point above the pivot aperture 640 on the first end 609 of the elongate arm member 606.

As shown in FIG. 17, the pivoting heel-cup 605 includes a plurality of apertures 638 each configured to be engaged with the first end 609 of the elongate arm member 606 such that the elongate arm member 606 may be pivoted at an axis aligning with any aperture of the plurality of apertures 638. By pivotably coupling the elongate arm member 606 to the one of the apertures 638 closest to the edge of the snowboard, the first end 609 of the elongate arm member 606 is coupled to an aperture of the plurality of apertures 638 such that the elongate arm member 606 and cuff member 608 coupled thereto are capable of pivoting fore and aft of a lateral axis of a snowboard while remaining substantially rigid along the lateral axis, allowing for some flexibility in the elongate arm member 608 as described above with respect to the elongate arm member 106. In FIG. 17, the binding apparatus 600 is shown positioned at an angle relative to the lateral axis of the snowboard. If a rider desires to position the binding apparatus 600 at a different angle relative to the lateral axis of the snowboard, the rider may disengage the first end 609 of the elongate arm member 606 from the aperture of the plurality of apertures 638 to which it was coupled and selectively couple the first end 609 of the elongate arm member 606 to a different aperture of the plurality of apertures 638 such that the pivot axis is substantially coincident with the lateral axis of the snowboard. So configured, the binding apparatus 600 is adjustable to accommodate changes to the angle at which the footbed 604 is attached to the snowboard while providing tip-to-tail movement of the binding apparatus 600 and restricting movement along the lateral axis of the snowboard. Limitations in the adjustability of the pivot axis of the elongate arm member 606 may prevent the pivot axis from being precisely aligned with the lateral axis of the snowboard, but the teachings disclosed herein allow for some misalignment in either or both the longitudinal and vertical directions relative to the lateral axis of the snowboard, as discussed above in the description of FIGS. 1-4. In alternative embodiments, the binding apparatus 600 includes other mechanisms for adjusting the location of the pivot axis relative to the pivoting heel cup 605. These include apertures 638 being slotted or ratcheting or threaded adjustment mechanisms configured to allow adjustment of the position of the pivot aperture 640 of the elongate arm member 606.

FIG. 18 shows an exploded view of the footbed 604, pivoting heel cup 605, and first end 609 of the elongate arm member 606. As illustrated, the plurality of apertures 638 are spaced about the base of the U-shaped pivoting heel cup 605. The first end 609 of the elongate arm member 606 includes an aperture 640 corresponding with the apertures 638 of the pivoting heel cup 605 such that one of the apertures 638 and the aperture 640 may be coaxially aligned and selectively coupled via a pin or other like locking structure to permit the fore and aft movement hereinbefore described.

The term "snowboard" as used herein should be understood to encompass a variety of snow-sliding devices including, but not limited to, skis, mono-skis, snowboards, or standing sleds. Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The disclosure is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the disclosure and does not pose a limitation on the scope of the disclosure. Any statement herein as to the nature or benefits of the disclosed device or of the preferred embodiments is not intended to be limiting. This invention includes all modifications and equivalents of the subject matter recited herein as permitted by applicable law. Moreover, any combination of the above-described elements in all possible variations thereof is encompassed by the disclosure unless otherwise indicated herein or otherwise clearly contradicted by context. No unclaimed language should be deemed to limit the invention in scope. Any statements or suggestions herein that certain features constitute a component of the claimed invention are not intended to be limiting unless reflected in the appended claims.

What is claimed is:

1. A binding apparatus comprising:

a base plate configured to be mounted to a snowboard;

a pivot portion extending upwardly from the base plate, the pivot portion defining a pivot portion axis of rotation configured to be substantially aligned with a lateral axis of the snowboard;

an elongate arm member including a first end portion pivotably coupled to the pivot portion of the base plate; and a cuff member coupled to the elongate arm member and configured to selectively engage a leg of a snowboard rider;

straps configured to selectively couple a foot of the snowboard rider to the binding apparatus at an adjustable angular position on the base plate relative to the pivot portion axis of rotation;

wherein the elongate arm member is configured to pivot about the pivot portion axis of rotation such that the elongate arm member and the cuff member coupled thereto are capable of movement substantially parallel to a longitudinal axis of the snowboard.

2. The binding apparatus of claim 1, wherein the cuff member is configured to be coupled to the elongate arm member at one of a plurality of different locations along a length of the elongate arm member.

3. The binding apparatus of claim 1, further comprising a footbed coupled to the base plate, the footbed configured to pivot about a footbed axis of rotation such that the footbed may be selectively secured to the base plate at any one of a plurality of angular positions relative to the pivot portion axis of rotation.

4. The binding apparatus of claim 3, the footbed further comprising a hole located in a heel portion of the footbed such that the footbed is configured to pivot about the hole, the hole being coaxial with the footbed axis of rotation.

5. The binding apparatus of claim 4, the footbed further comprising at least one arcuate slot having a centerpoint at the hole and a radius of curvature corresponding to a distance between the hole and the at least one arcuate slot.

6. The binding apparatus of claim 5, the base plate further comprising a first hole to receive a fastener that passes through the hole in the heel portion of the footbed to pivotably secure the footbed thereto.

7. The binding apparatus of claim 6, the base plate further comprising a plurality of second holes arranged along an arc having a centerpoint at the first hole and a radius of curvature corresponding to the radius of curvature of the at least one arcuate slot on the footbed.

8. The binding apparatus of claim 1, wherein the base plate and the pivot portion are monolithic.

9. The binding apparatus of claim 1, the base plate further comprising at least one row of holes aligned in a direction parallel to the pivot portion axis of rotation, the at least one row of holes configured for attaching the base plate to the snowboard.

10. The binding apparatus of claim 1, wherein the elongate arm member is substantially rigid.

11. The binding apparatus of claim 1, wherein the elongate arm member is angled outwardly in a direction of the pivot portion axis of rotation.

12. The binding apparatus of claim 1, wherein a length of the elongate arm member is adjustable.

13. The binding apparatus of claim 12, wherein a second upper portion of the elongate arm member includes a plurality of apertures interspersed along a length thereof; and wherein the first end portion of the elongate arm member is configured to be coupled to the second upper portion via a through hole of the first end portion configured to receive a fastener that passes through at least one of the plurality of apertures interspersed along the length of the second upper portion.

14. A binding apparatus comprising:

a base plate configured to be mounted to a snowboard, the base plate including a pivot portion having a pivot portion axis of rotation configured to be substantially aligned with a lateral axis of the snowboard;

a footbed configured to selectively couple a foot of a snowboard rider to the base plate;

at least one fastener configured to attach the footbed to the base plate at an adjustable angle relative to the pivot portion axis of rotation;

an elongate arm member pivotably coupled to the pivot portion of the base plate; and a cuff member operatively coupled to the elongate arm member and configured to selectively engage a leg of the snowboard rider;

wherein the elongate arm member is configured to pivot about the pivot portion axis of rotation such that the elongate arm member and the cuff member coupled thereto are capable of movement substantially parallel to a longitudinal axis of the snowboard.

15. The binding apparatus of claim 14, the elongate arm member further comprising:

a first end portion; and a second upper portion including a plurality of apertures interspersed along a length thereof;

wherein the second upper portion is at least partially telescopically received in the first end portion, and wherein a length of the elongate arm member is adjustable by selectively coupling the first end portion to the second upper portion using at least one selected aperture of the plurality of apertures.

16. The binding apparatus of claim 14, wherein the elongate arm member is angled outwardly in a direction of the pivot portion axis of rotation.

17. A binding system comprising:

a first binding apparatus and a second binding apparatus configured to attach to a snowboard, the first and second binding apparatuses each comprising:

a base plate configured to be mounted to the snowboard, the base plate including a pivot portion having an axis of rotation configured to be substantially aligned with the lateral axis of the snowboard;

a footbed configured to selectively couple a foot of a snowboard rider the base plate, the footbed configured to attach to the base plate at one of a plurality of angular positions relative to the pivot portion axis of rotation;

an elongate arm member pivotably coupled to the pivot portion of the base plate; and a cuff member operatively coupled to the elongate arm member and configured to selectively engage a leg of a snowboard rider;

wherein the footbed of the first binding apparatus is configured to attach to the corresponding base plate at a first angular position relative to the pivot portion axis of rotation and the footbed of the second binding apparatus is configured to attach to the corresponding base plate at a second angular position relative to the pivot portion axis of rotation.

18. The binding system of claim 17, wherein each footbed is configured to pivot about a respective footbed axis of rotation located in a heel portion of the footbed.

19. The binding system of claim 17, wherein the elongate arm member of the first binding apparatus is angled inwardly in a direction of the pivot portion axis of rotation, and wherein the elongate arm member of the second binding apparatus is angled outwardly in the direction of the pivot portion axis of rotation.

20. A ridable board comprising:

a board substantially longer along a longitudinal axis than the board is wide along a lateral axis;

at least one binding apparatus comprising:

a base plate mounted to the board;

at least one pivot portion adjacent to an edge of the board, the pivot portion extending upwardly from the base plate and having a pivot portion axis of rotation configured to be substantially parallel to the lateral axis of the board;

an elongate arm member pivotably coupled to the pivot portion;

a cuff member coupled to the elongate arm member;

a footbed coupled to the base plate and configured to pivot about a footbed axis of rotation located in a heel portion of the footbed to one of a plurality of angular positions relative to the pivot portion axis of rotation;

wherein the elongate arm member is configured to pivot about the pivot portion axis of rotation such that the elongate arm member and the cuff member coupled thereto are capable of movement substantially parallel to the longitudinal axis of the board.

* * * * *